US009555942B2

(12) United States Patent
Ackerman

(10) Patent No.: US 9,555,942 B2
(45) Date of Patent: Jan. 31, 2017

(54) LOCKING MEDICINE CONTAINER

(71) Applicant: Brent Bradley Ackerman, Bremerton, WA (US)

(72) Inventor: Brent Bradley Ackerman, Bremerton, WA (US)

( * ) Notice: Subject to any disclaimer, the term of this patent is extended or adjusted under 35 U.S.C. 154(b) by 22 days.

(21) Appl. No.: 13/986,798

(22) Filed: Jun. 5, 2013

(65) Prior Publication Data

US 2014/0360969 A1 Dec. 11, 2014

(51) Int. Cl.

| | |
|---|---|
| ***B65D 55/14*** | (2006.01) |
| ***E05B 37/02*** | (2006.01) |
| ***B65D 50/06*** | (2006.01) |
| *B65D 85/24* | (2006.01) |

(52) U.S. Cl.

CPC ..... *B65D 55/145* (2013.01); *B65D 50/062* (2013.01); *E05B 37/02* (2013.01); *B65D 85/24* (2013.01)

(58) Field of Classification Search

CPC ..... B65D 55/145; B65D 85/24; B65D 50/06; B65D 50/061; B65D 50/062; E05B 37/02

USPC ..... 215/208, 228, 206; 70/26, 312, 315–318

See application file for complete search history.

(56) References Cited

U.S. PATENT DOCUMENTS

| | | | | | |
|---|---|---|---|---|---|
| 446,657 | A | | 3/1891 | Baum | |
| 1,649,372 | A | | 11/1927 | Tait | |
| 3,405,828 | A | * | 10/1968 | St Pierre | B65D 55/145 215/206 |
| 3,407,954 | A | | 10/1968 | Mekes | |
| 3,421,347 | A | * | 1/1969 | Sotory | B65D 55/145 70/163 |
| 3,445,021 | A | * | 5/1969 | Johnson | B65D 55/145 215/206 |
| 3,684,117 | A | | 8/1972 | Leopold | |
| 3,843,007 | A | | 10/1974 | Mayer | |
| 3,850,324 | A | | 11/1974 | Mayer | |
| 4,059,198 | A | | 11/1977 | Mumford | |
| 4,779,747 | A | * | 10/1988 | Morel | B65D 55/145 215/206 |
| 4,782,963 | A | | 11/1988 | Hunter | |
| 4,991,729 | A | | 2/1991 | Hunter | |
| 5,277,325 | A | * | 1/1994 | Yan | B65D 55/145 215/206 |
| 5,317,796 | A | | 6/1994 | Hunter | |
| 6,122,945 | A | * | 9/2000 | Grant | E05B 17/145 292/DIG. 2 |
| 7,107,803 | B1 | * | 9/2006 | Swanson | E05B 37/02 70/163 |
| 8,944,263 | B1 | * | 2/2015 | Small | E05B 65/0014 215/206 |
| 2003/0075932 | A1 | * | 4/2003 | Dolan | B65D 50/062 292/300 |

(Continued)

*Primary Examiner* — James N Smalley

(57) ABSTRACT

One component or embodiment of a locking medical container is the quality of the material used. The sterile non-chemically reactive polypropylene container is suitable for most medical applications. The lock and all its components are made strong to secure the medications from all but the prescribed user. This is done by using a structural method that joins the parts in such a manner as to produce a solid locking unit. The snap in capability of some of the parts used remove manufacture difficulties that are found in other locking devices. This unit when completed is sealed, sterile and very strong. The user simply rotates the tumbler and removes the cavity obstruction to gain access to the contents of the container.

2 Claims, 41 Drawing Sheets

(56) References Cited

U.S. PATENT DOCUMENTS

| | | | | |
|---|---|---|---|---|
| 2011/0174758 | A1* | 7/2011 | | Gonzalez |
| | | | Sanchez | B65D 55/145 |
| | | | | 215/206 |
| 2013/0062303 | A1* | 3/2013 | Serell | A61J 1/03 |
| | | | | 215/206 |

* cited by examiner

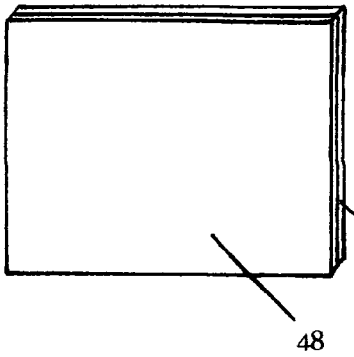
FIG. 29
FIG. 30
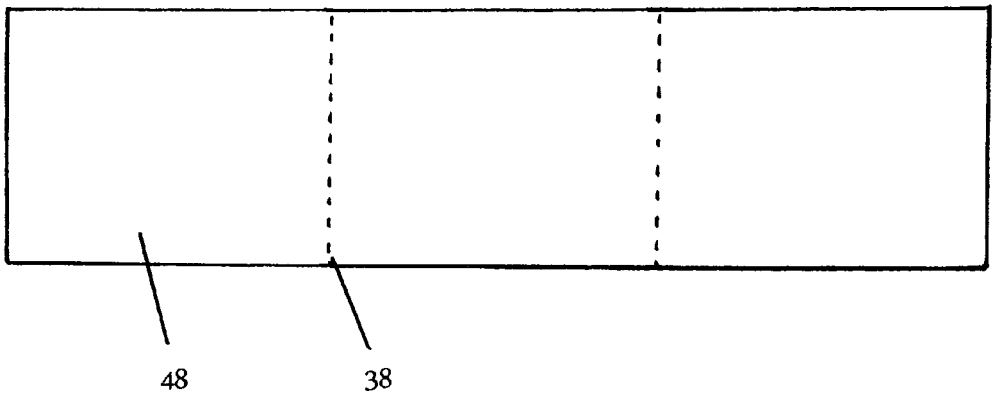
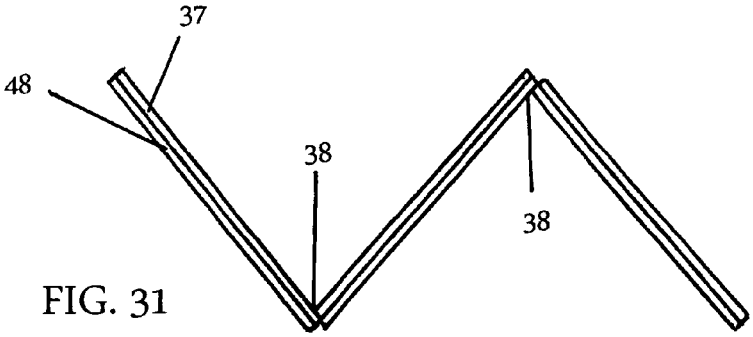
FIG. 31

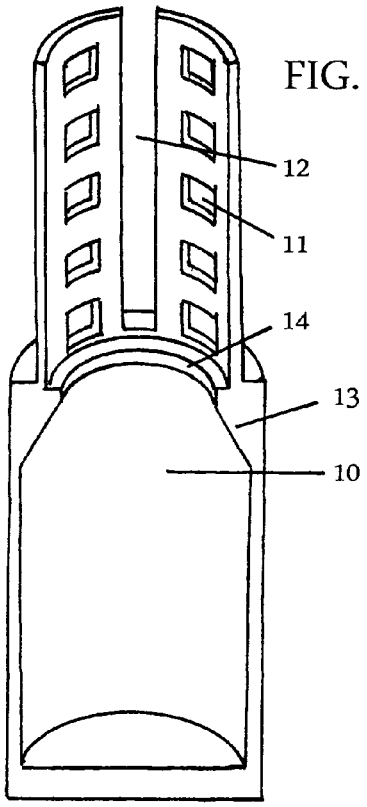
FIG. 33
FIG. 32
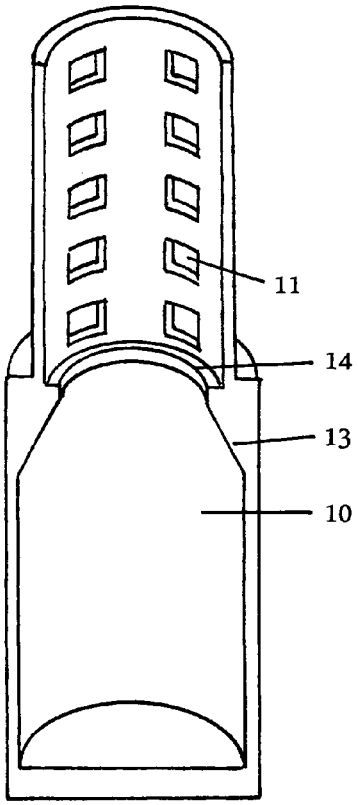
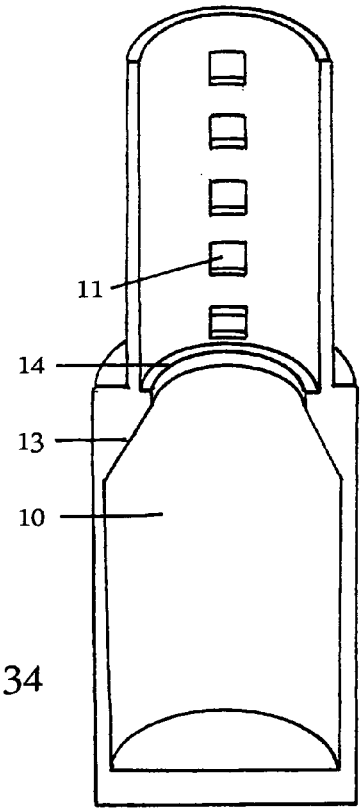
FIG. 34

FIG. 36
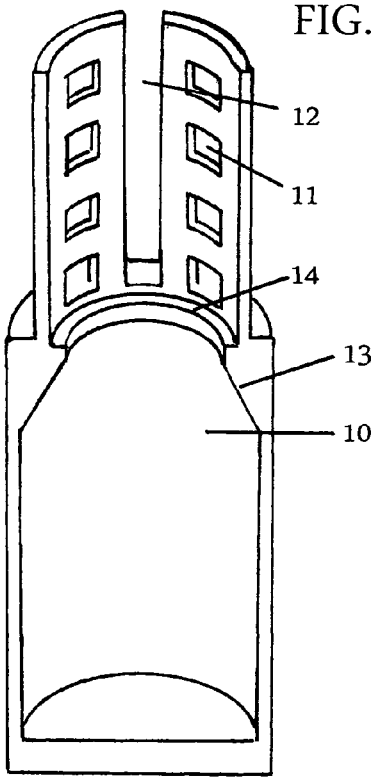
FIG. 35
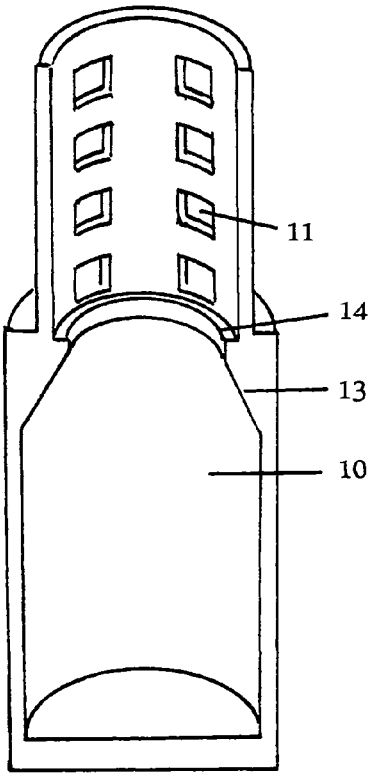
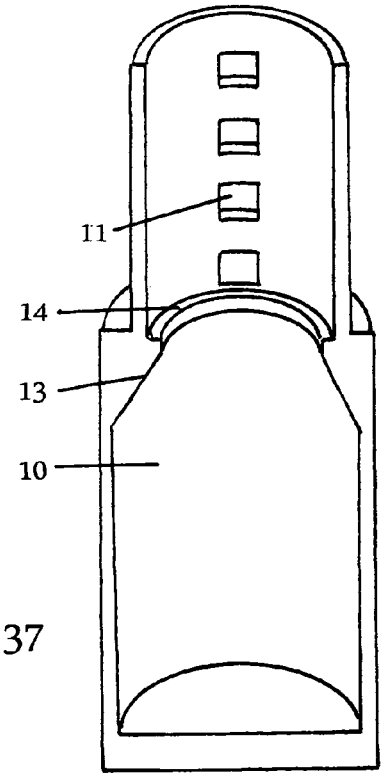
FIG. 37

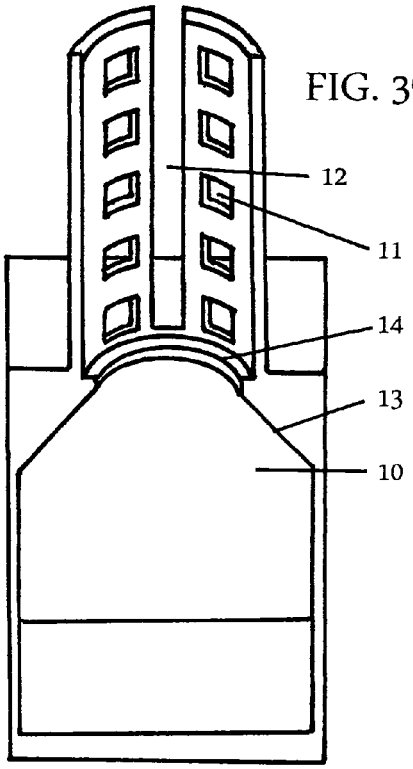
FIG. 39
FIG. 38
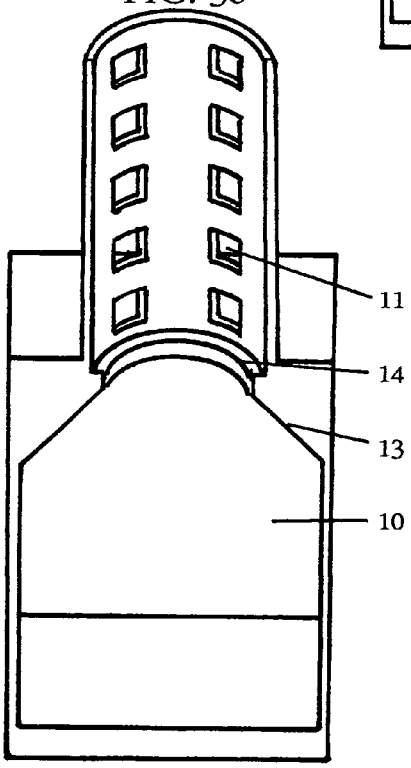
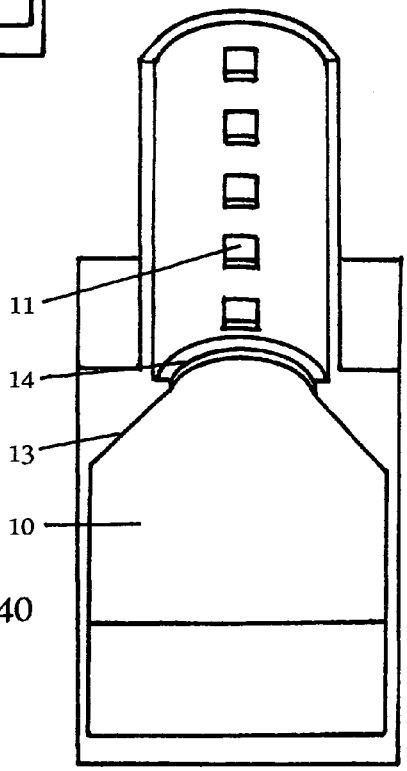
FIG. 40

FIG. 42
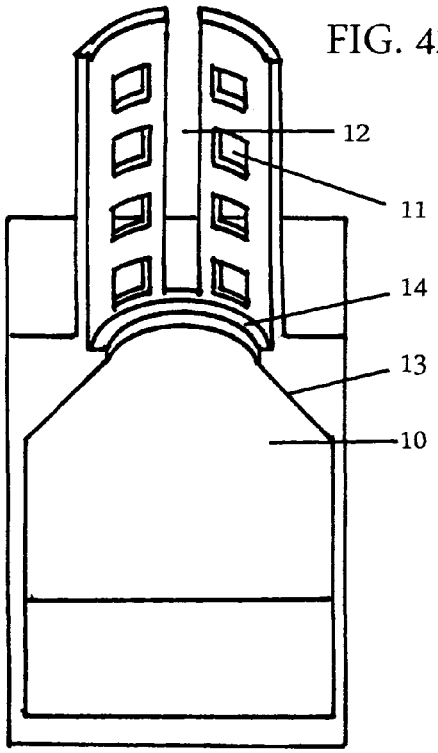
FIG. 41
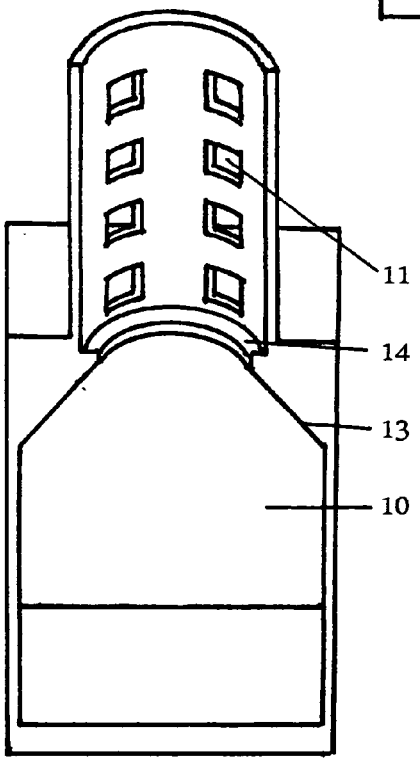
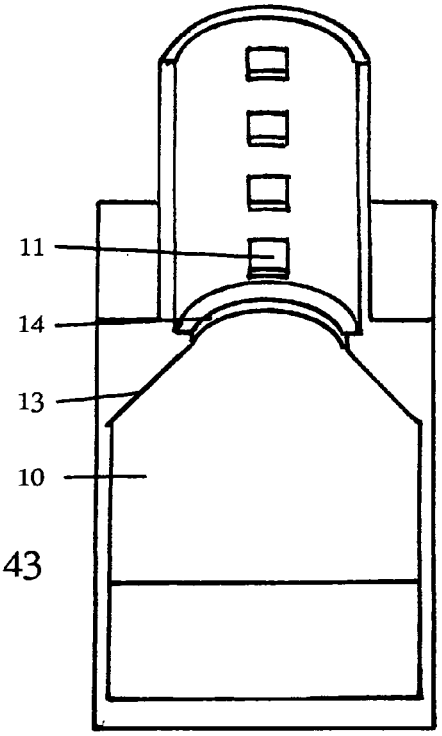
FIG. 43

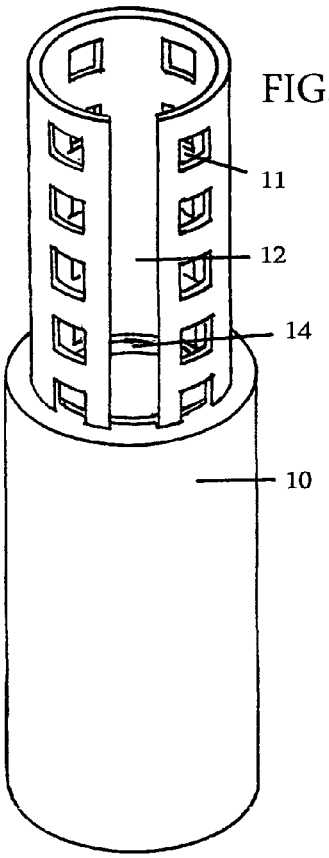
FIG. 49
FIG. 48
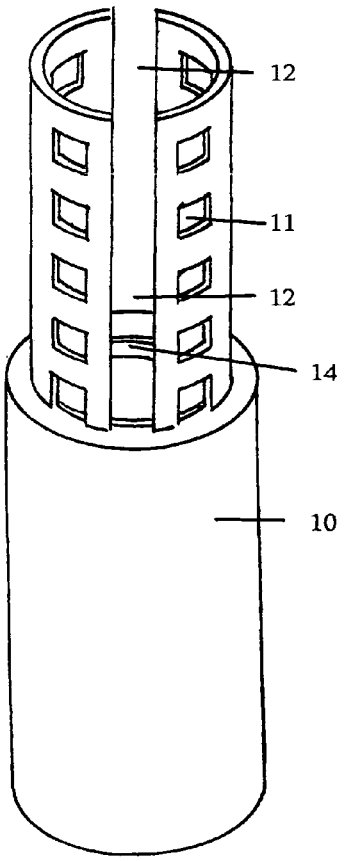
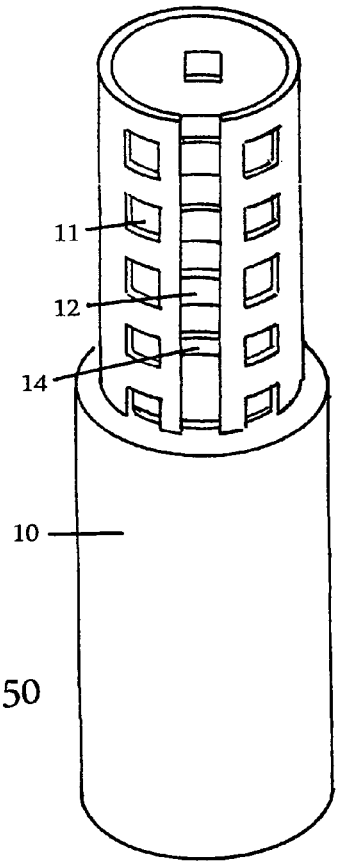
FIG. 50

FIG. 52
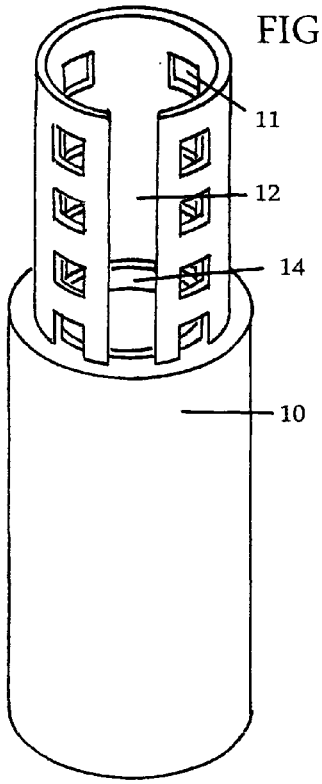
FIG. 51
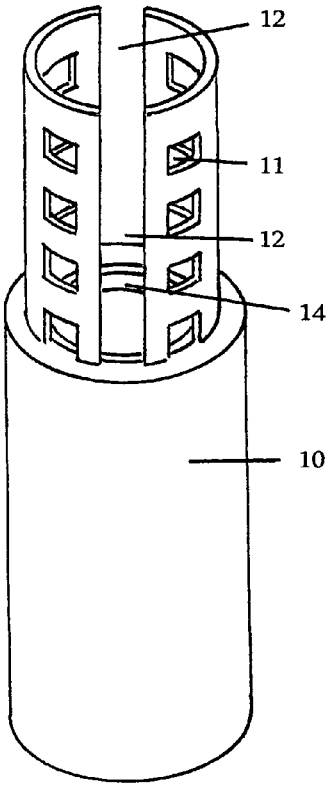
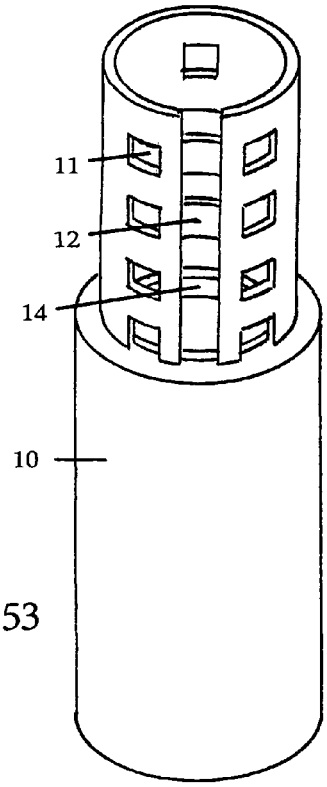
FIG. 53

FIG. 72
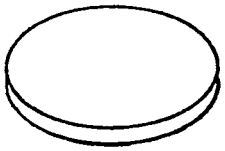
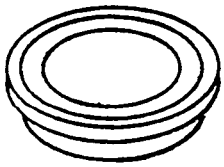
FIG. 73
FIG. 74
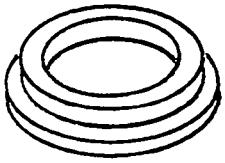
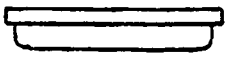
FIG. 75

FIG. 76
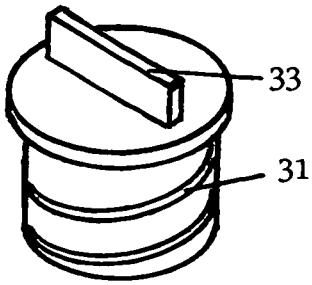
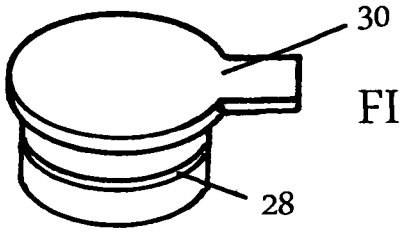
FIG. 77
FIG. 78
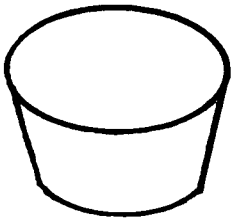
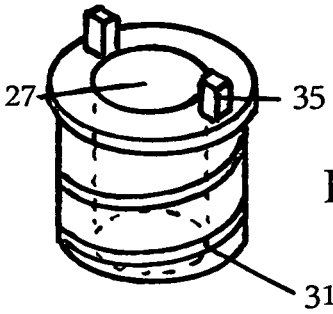
FIG. 79

FIG. 81
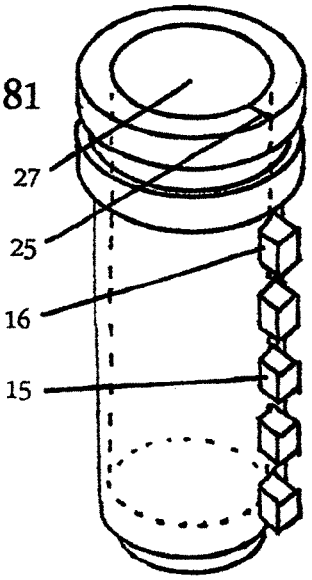
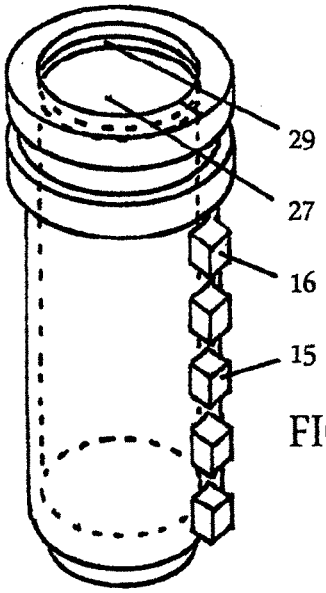
FIG. 82
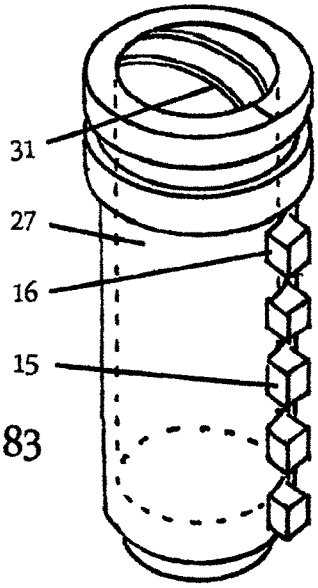
FIG. 83
FIG. 84
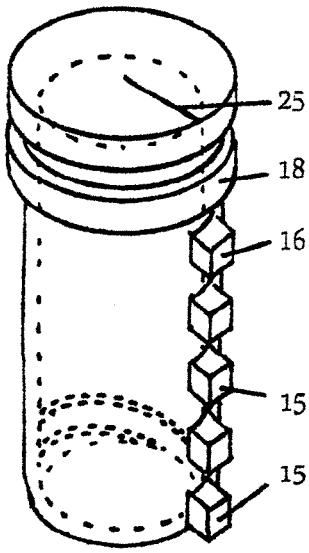

FIG. 86
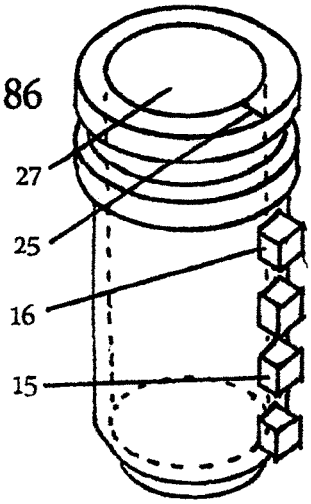
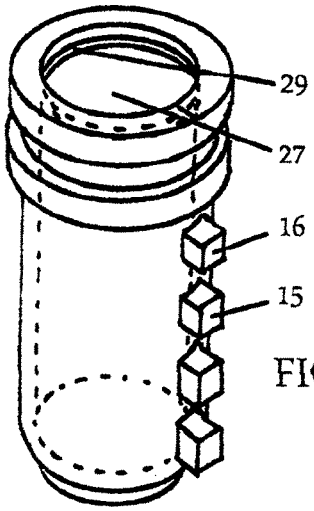
FIG. 87
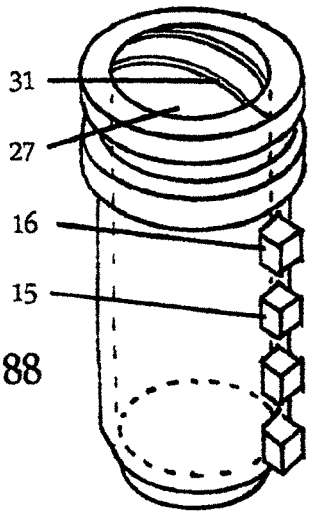
FIG. 88
FIG. 89
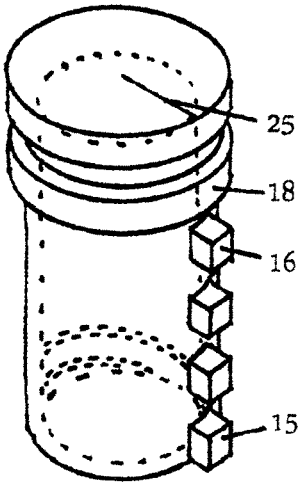

FIG. 91
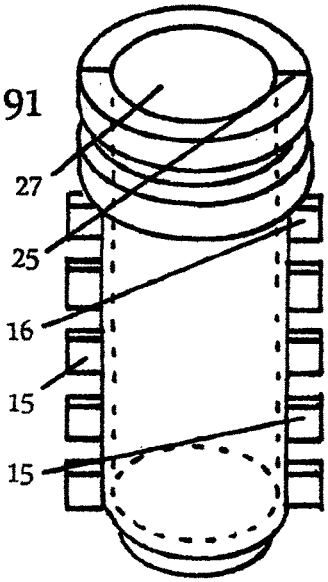
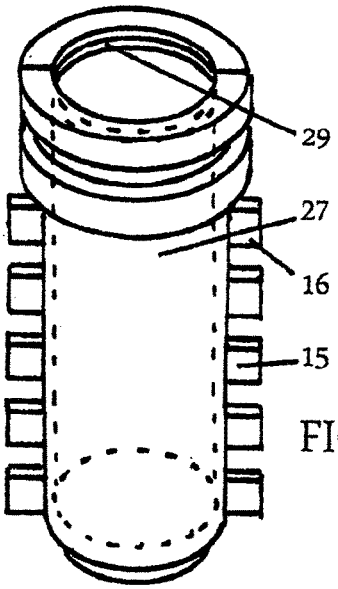
FIG. 92
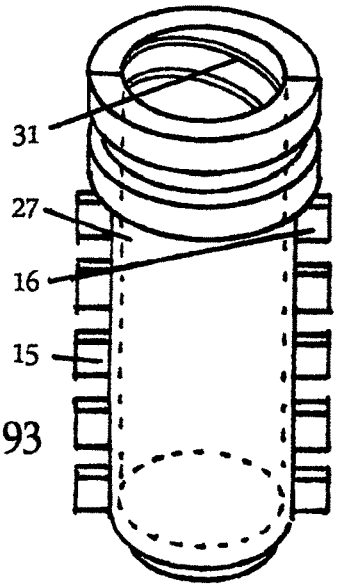
FIG. 93
FIG. 94
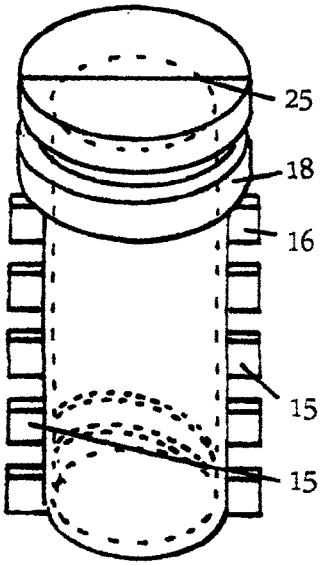

FIG. 96
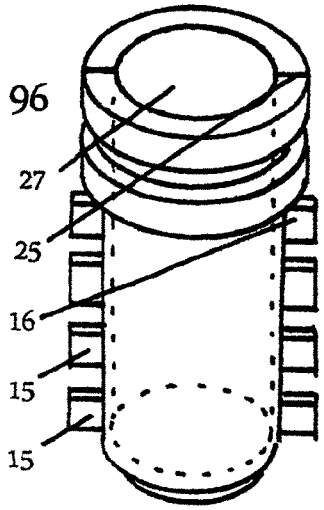
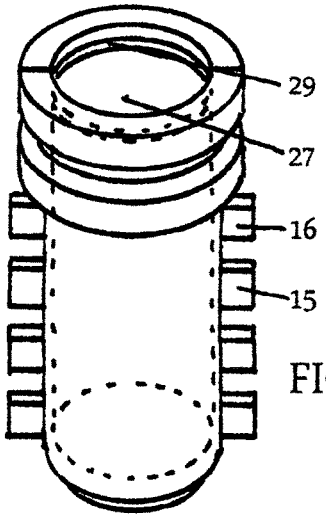
FIG. 97
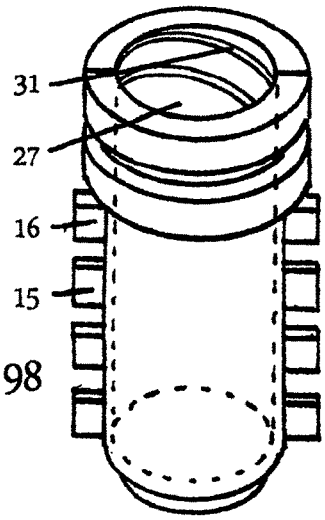
FIG. 98
FIG. 99
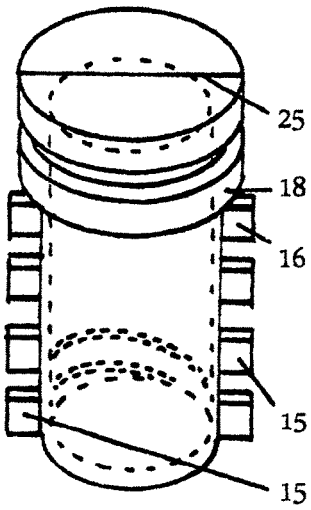

FIG. 101
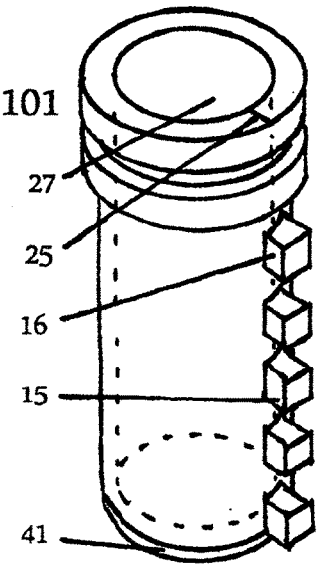
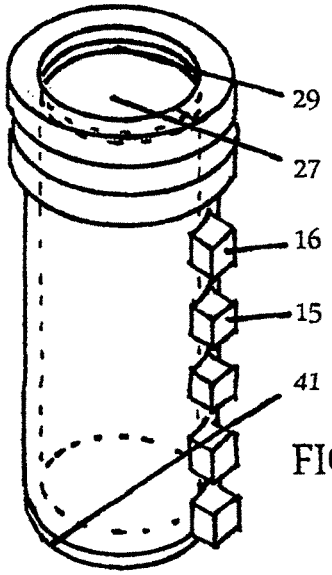
FIG. 102
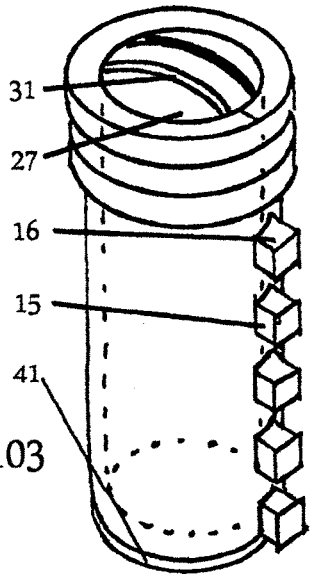
FIG. 103

FIG. 105
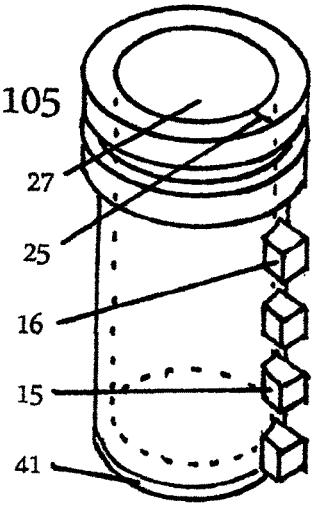
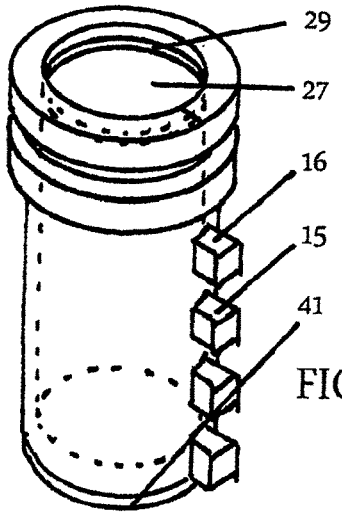
FIG. 106
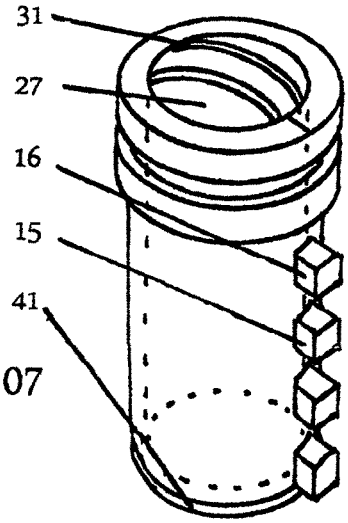
FIG. 107

FIG. 109
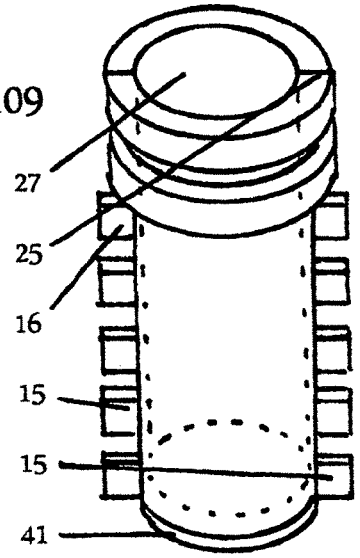
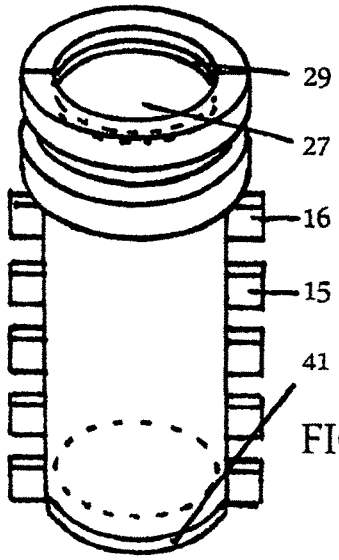
FIG. 110
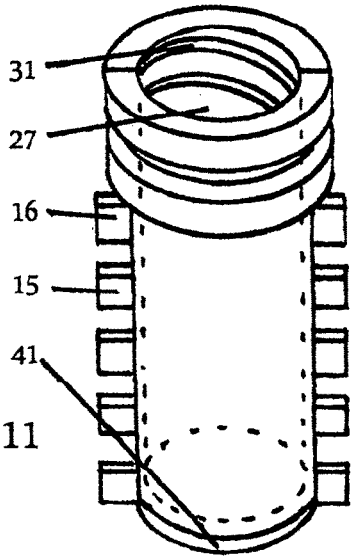
FIG. 111

FIG. 113
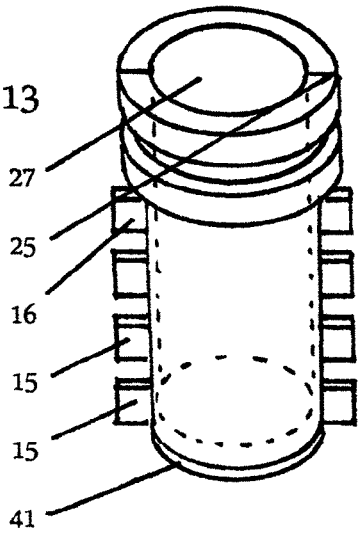
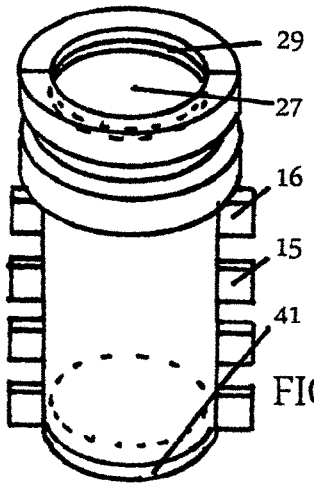
FIG. 114
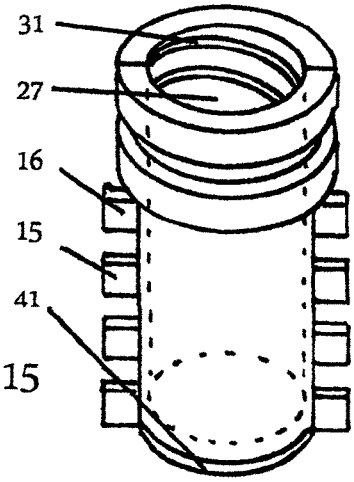
FIG. 115

FIG. 117
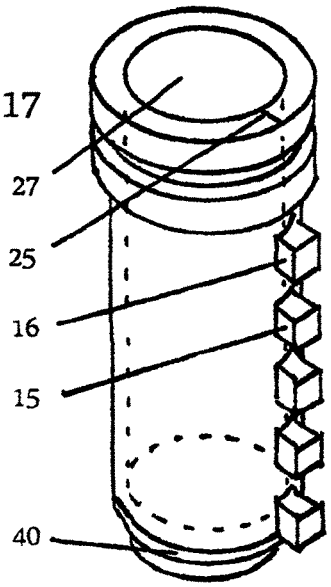
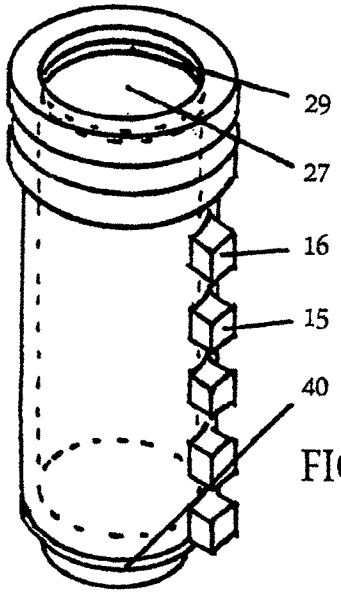
FIG. 118
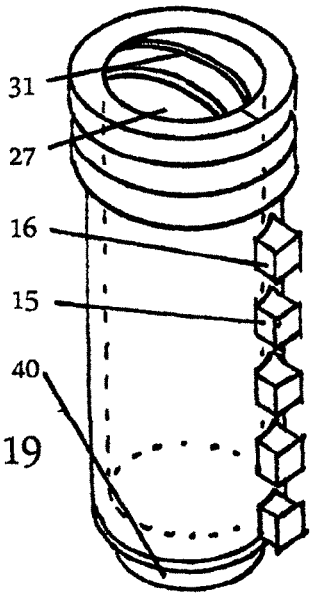
FIG. 119

FIG. 121
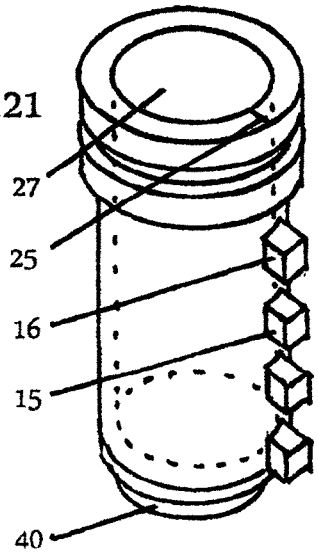
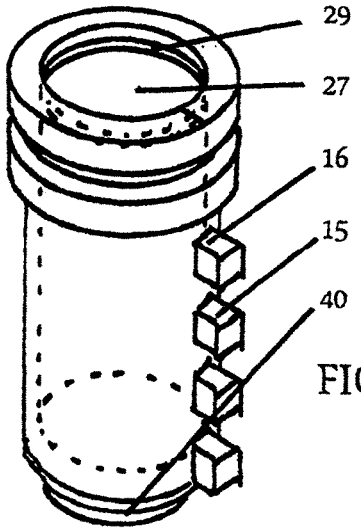
FIG. 122
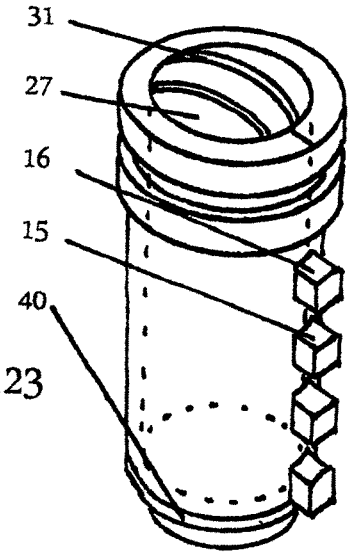
FIG. 123

FIG. 125
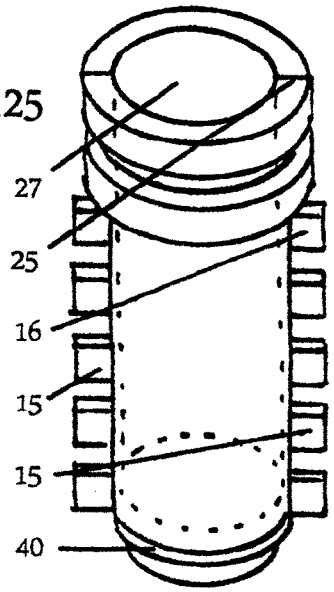
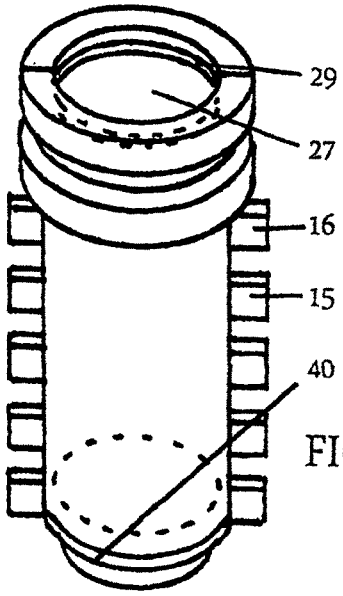
FIG. 126
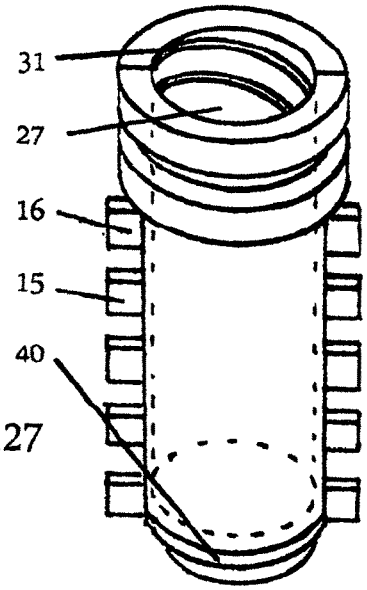
FIG. 127

FIG. 129
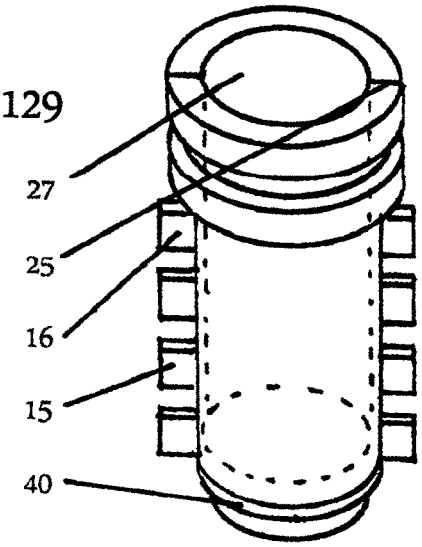
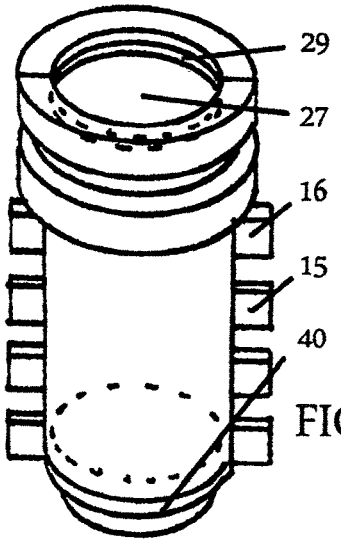
FIG. 130
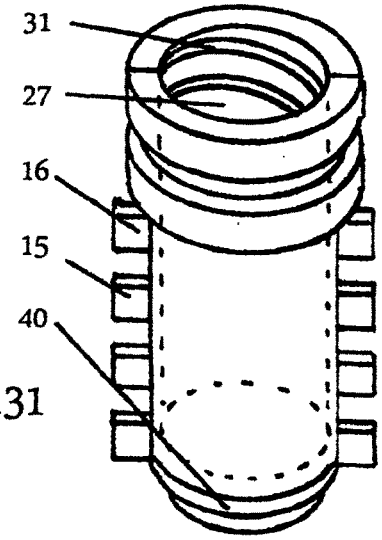
FIG. 131

LOCKING MEDICINE CONTAINER

CROSS-REFERENCE TO RELATED APPLICATIONS

Provisional Patent 61/689,628

FEDERALLY SPONSORED RESEARCH

Not Applicable

SEQUENCE LISTING OR PROGRAM

Not Applicable

BACKGROUND

Field

This invention relates to medical containers, specifically to child proof or locking containers.

Prior Art

The idea of a locking medicine container is far from new. Many attempts have been made to produce a commercial product that is economical and more to the point locks. The following information is given in reference to the field and should by the absence of any such product on the market found to be new and non-obvious.

The problem may lie with the position taken by the authorities and inventors of these products. They seem to want it to be opened easily by adults while denying children access. The pharmaceutical container described in U.S. Pat. No. 4,059,198 by Mumford is a perfect example of this easy for me attitude.

One inventor in the field Robert M. Hunter has produced several inventive childproof caps. Patents issued are U.S. Pat. No. 4,782,963, U.S. Pat. No. 4,991,729, U.S. Pat. No. 5,351,848 and U.S. Pat. No. 5,317,796. In these patents he describes ways to keep children from opening a pharmaceutical container while providing easy use for adults. He does not however mention any intention to keep adults out. The products he has made, while childproof, all lack the strength and durability to deny an adult entrance into the container. These containers with the locking caps are simply defeated by pulling off the top.

A combination cap U.S. Pat. No. 3,684,117 by Leopold et al. is only held together by two small thin pieces of plastic. Pierre U.S. Pat. No. 3,405,828 has its resistant pieces of less than an eighth of an inch. A. Millis U.S. Pat. No. 3,407,954 is another cap type child resistant unit with a limited number of indicia and the same thin plastic parts used to secure the container. The caps of Karl A. Meyer U.S. Pat. No. 3,843,007 and U.S. Pat. No. 3,850,324 are no better. The problem is the same with all of them they were built with components incapable of securing medications from adults.

The container made by Baum U.S. Pat. No. 446,657 falls prey to another shortcoming. The container itself, it is removable from its cap by simply bending the container. The savings bank by Tait U.S. Pat. No. 1,649,372 along with an invention by Small U.S. Pat. No. 7,255,504 give no view of the contents held within the containers. While others are too expensive more are not sterile or are fit to hold medications.

While the list goes on the number of prescription drug dependent teenagers and adults continue to rise. And with no means to prevent unauthorized use of these medications parents and their loved ones will continue to suffer from this problem. Without an alternative locking container at the pharmacy the futures of all too many individuals may be reduced by their own addictive nature.

SUMMARY

In accordance with one embodiment a locking container comprises strong durable construction and quality materials.

DRAWING FIGURES

FIG. 29 in perspective view is a label.

FIG. 30 is a front view of a perforated label.

FIG. 31 is a top view of a partially folded perforated label.

FIG. 32 is a four tumbler, round container half in perspective view with ten stator holes.

FIG. 33 is a four tumbler, round container half in perspective view with a slot and ten stator holes.

FIG. 34 is a four tumbler, round container half in perspective view with five stator holes.

FIG. 35 is a three tumbler, round container half in perspective view with eight stator holes.

FIG. 36 is a three tumbler, round container half in perspective view with a slot and eight stator holes.

FIG. 37 is a three tumbler, round container half in perspective view with four stator holes.

FIG. 38 is a four tumbler, square container half in perspective view with ten stator holes.

FIG. 39 is a four tumbler, square container half in perspective view with a slot and ten stator holes.

FIG. 40 is a four tumbler, square container half in perspective view with five stator holes.

FIG. 41 is a three tumbler, square container half in perspective view with eight stator holes.

FIG. 42 is a three tumbler, square container half in perspective view with a slot and eight stator holes.

FIG. 43 is a three tumbler, square container half in perspective view with four stator holes.

Figure 44:
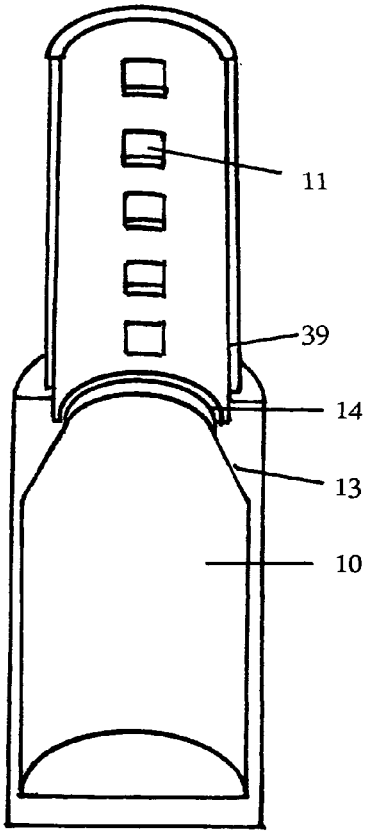

FIG. 44 is a four tumbler, round container half with two half slots in perspective view and five stator holes.

Figure 45:
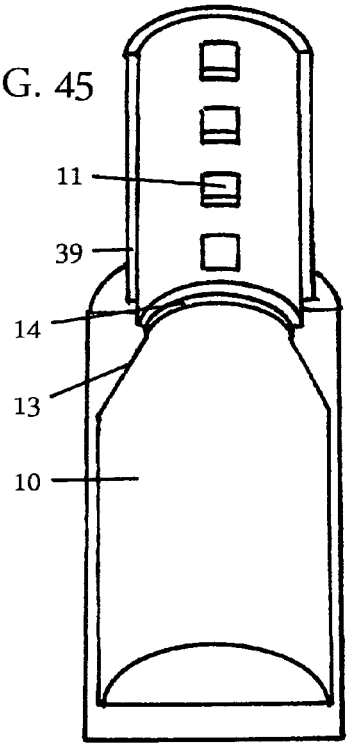

FIG. 45 is a three tumbler, round container half with two half slots in perspective view and four stator holes.

Figure 46:
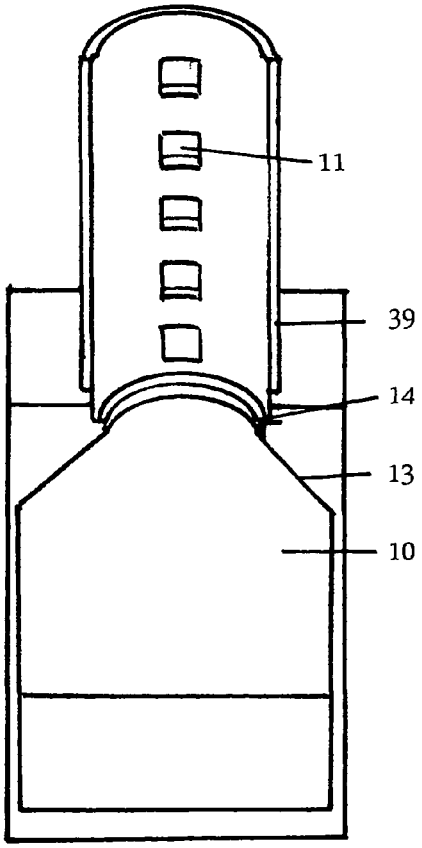

FIG. 46 is a four tumbler, square container half in perspective view with two half slots and five stator holes.

Figure 47:
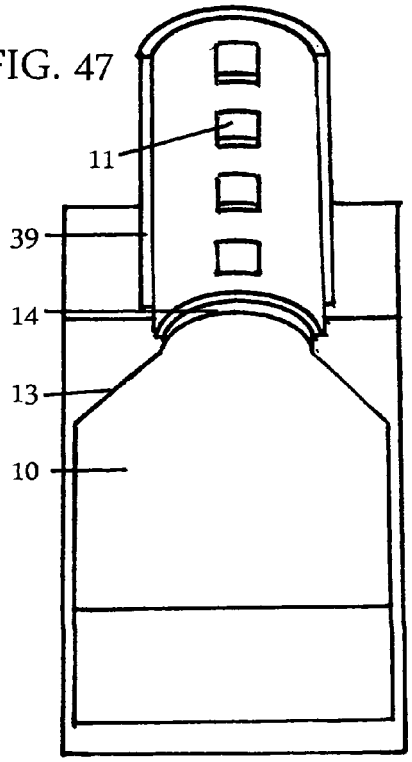

FIG. 47 is a three tumbler, square container half in perspective view with two half slots and four stator holes.

FIG. 48 is a four tumbler, round container in perspective view with two slots and twenty stator holes.

FIG. 49 is a four tumbler, round container in perspective view with one slot and twenty stator holes.

FIG. 50 is a four tumbler, round container in perspective view with one slot and fifteen stator protrusion holes.

FIG. 51 is a three tumbler, round container in perspective view with two slots and sixteen stator protrusion holes.

FIG. 52 is a three tumbler, round container in perspective view with a single slot and sixteen stator protrusion holes.

FIG. 53 is a three tumbler, round container in perspective view with one slot and twelve stator protrusion holes.

Figure 54:
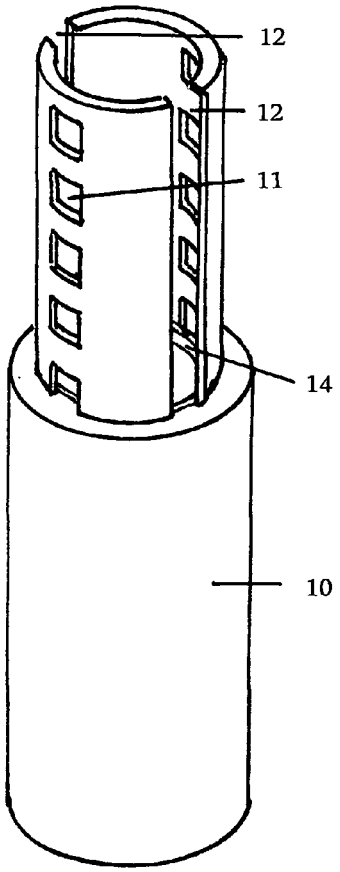

FIG. 54 is a four tumbler, round container in perspective view with two slots and ten stator protrusion holes.

Figure 55:
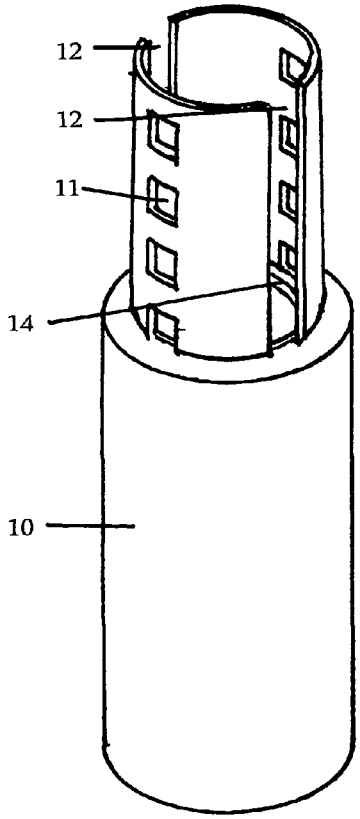

FIG. 55 is a three tumbler, round container in perspective view with two slots and eight stator protrusion holes.

Figure 56:
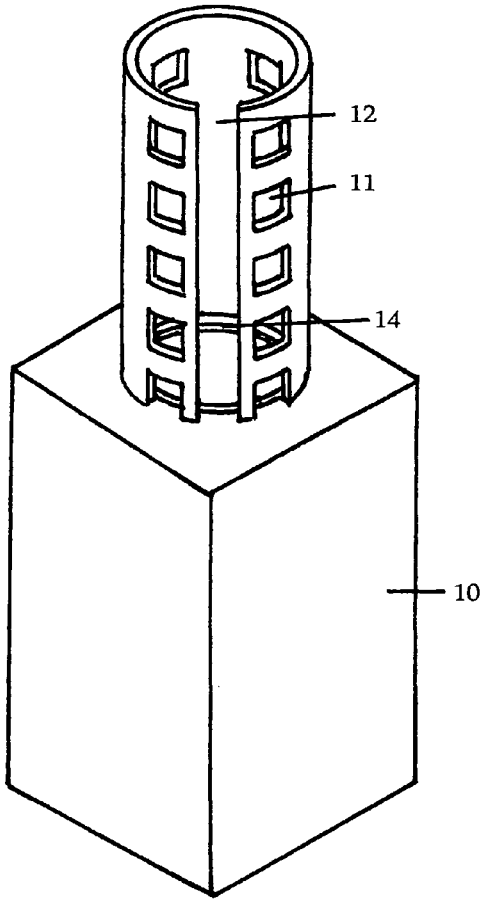

FIG. 56 is a four tumbler, square container in perspective view with one slot and twenty stator protrusion holes.

Figure 57:
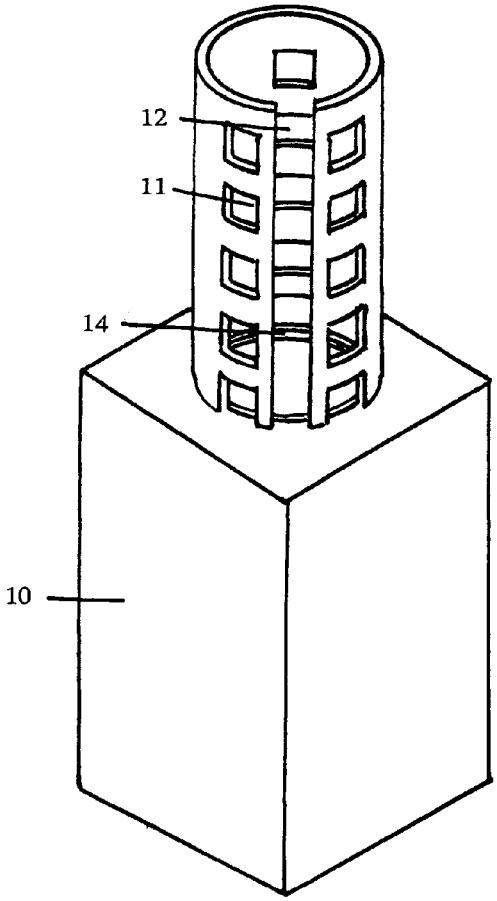

FIG. 57 is a four tumbler, square container in perspective view with one slot and fifteen stator protrusion holes.

Figure 58:
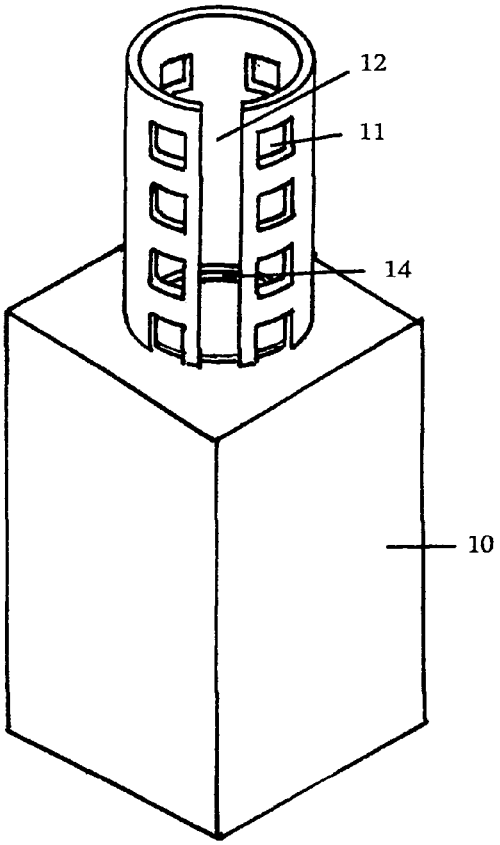

FIG. 58 is a three tumbler, square container in perspective view with one slot and sixteen stator protrusion holes.

Figure 59:
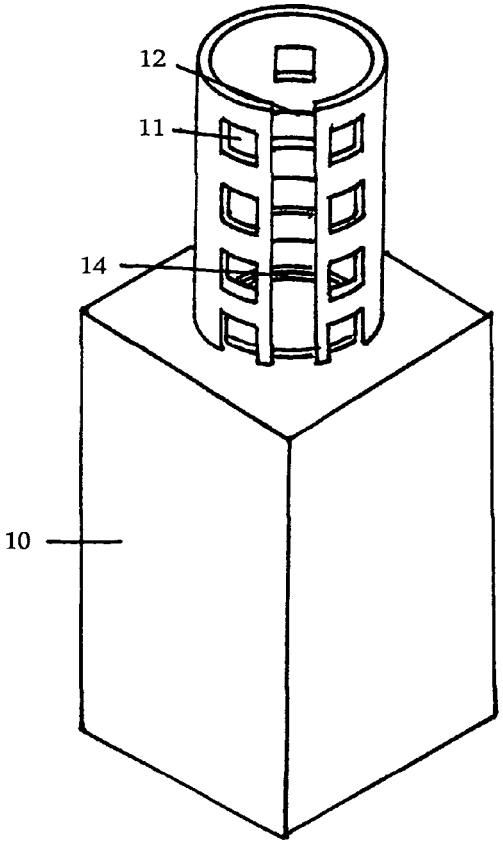

FIG. 59 is a three tumbler, square container in perspective view with one slot and twelve stator protrusion holes.

Figure 60:
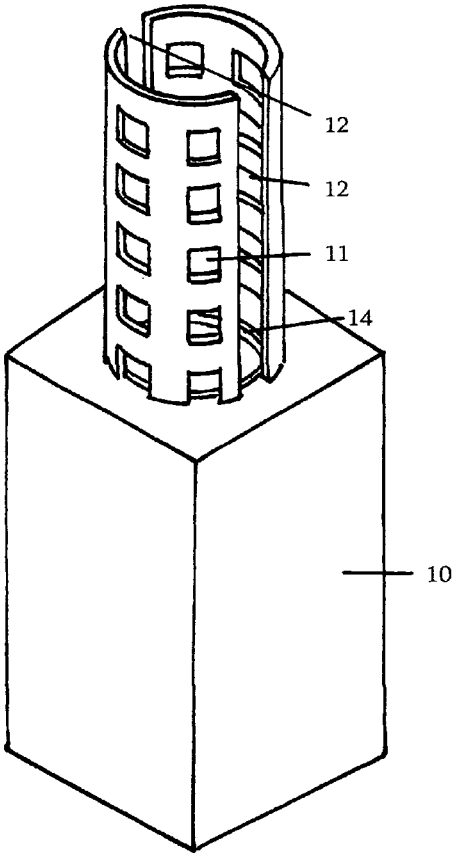

FIG. 60 is a four tumbler, square container in perspective view with two slots and twenty stator protrusion holes.

Figure 61:
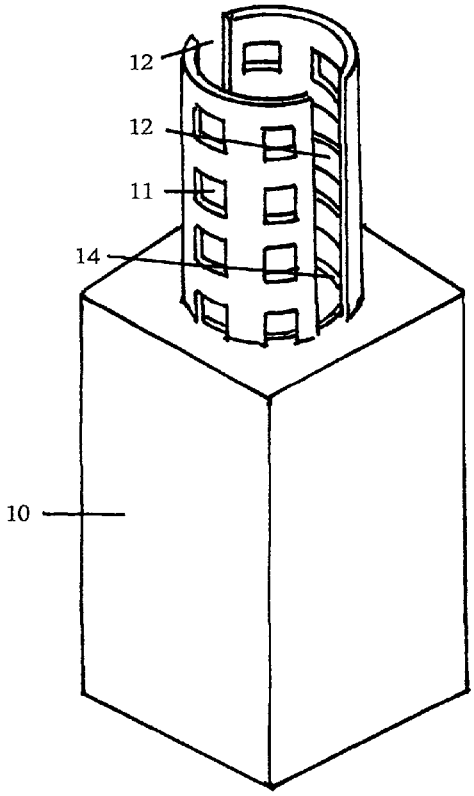

FIG. 61 is a three tumbler, square container in perspective view with two slots and sixteen stator protrusion holes.

Figure 62:
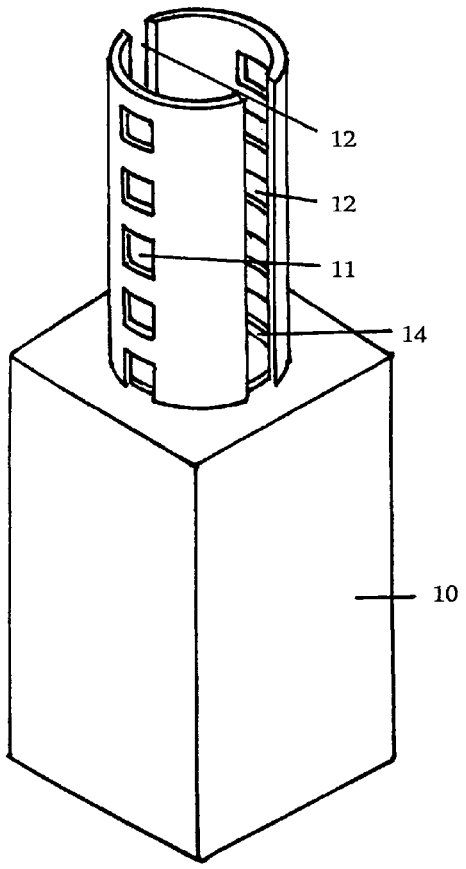

FIG. 62 is a four tumbler, square container in perspective view with two slots and ten stator protrusion holes.

Figure 63:
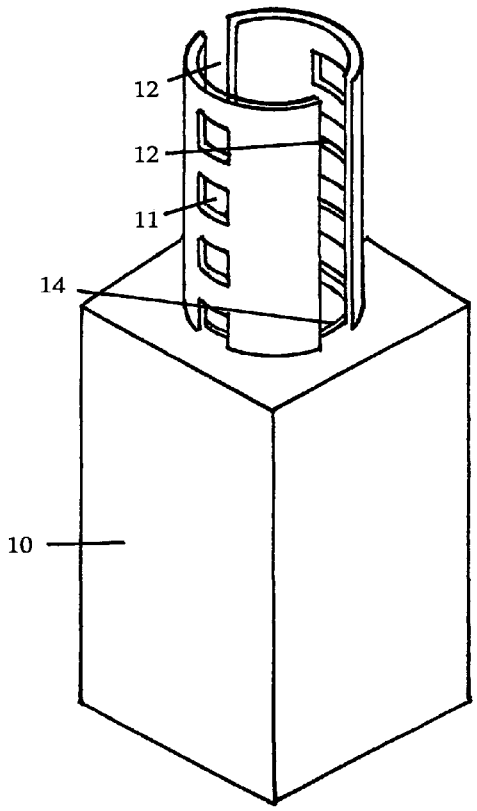

FIG. 63 is a three tumbler, square unit in perspective view with two half slots and eight stator protrusion holes.

Figure 64:
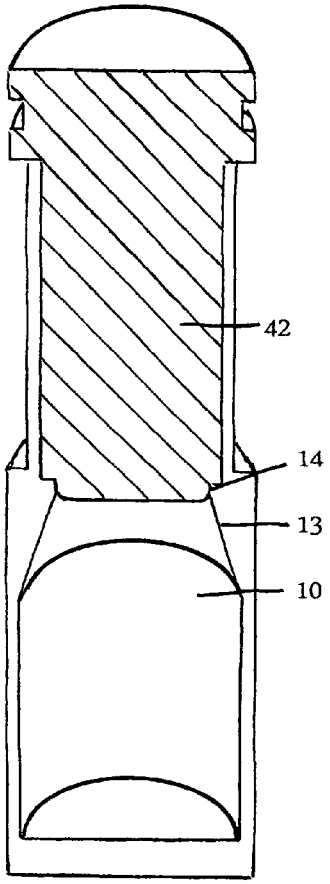

FIG. 64 is a round container half with a plug half inserted.

Figure 65:
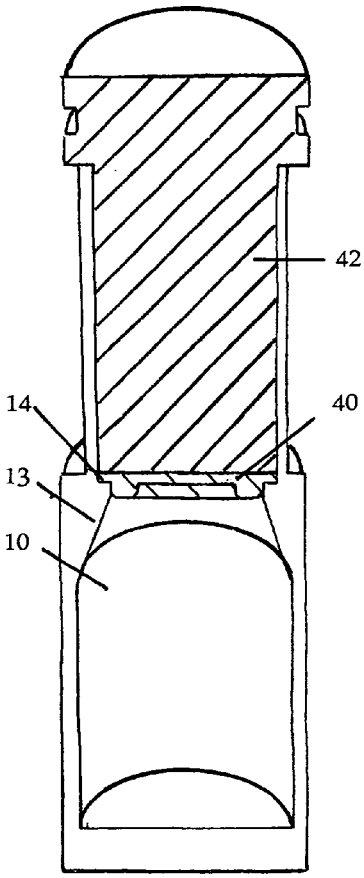

FIG. 65 is a round container half in perspective view and a plug half with a plastic seal attached and inserted.

Figure 66:
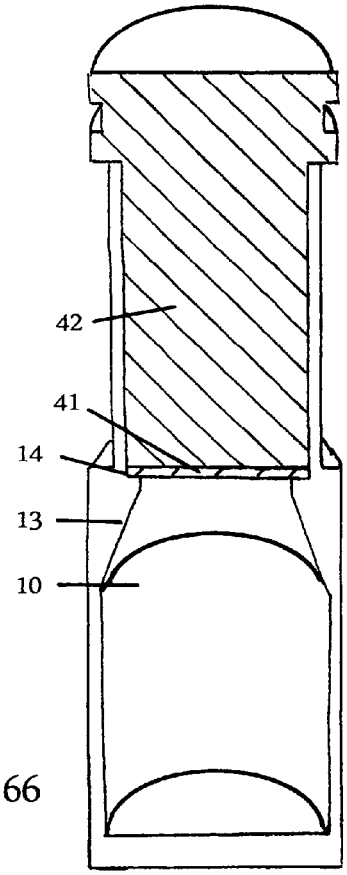

FIG. 66 is a round container half in perspective view and a plug half with a rubber seal attached and inserted.

Figures 67, 68, 69:
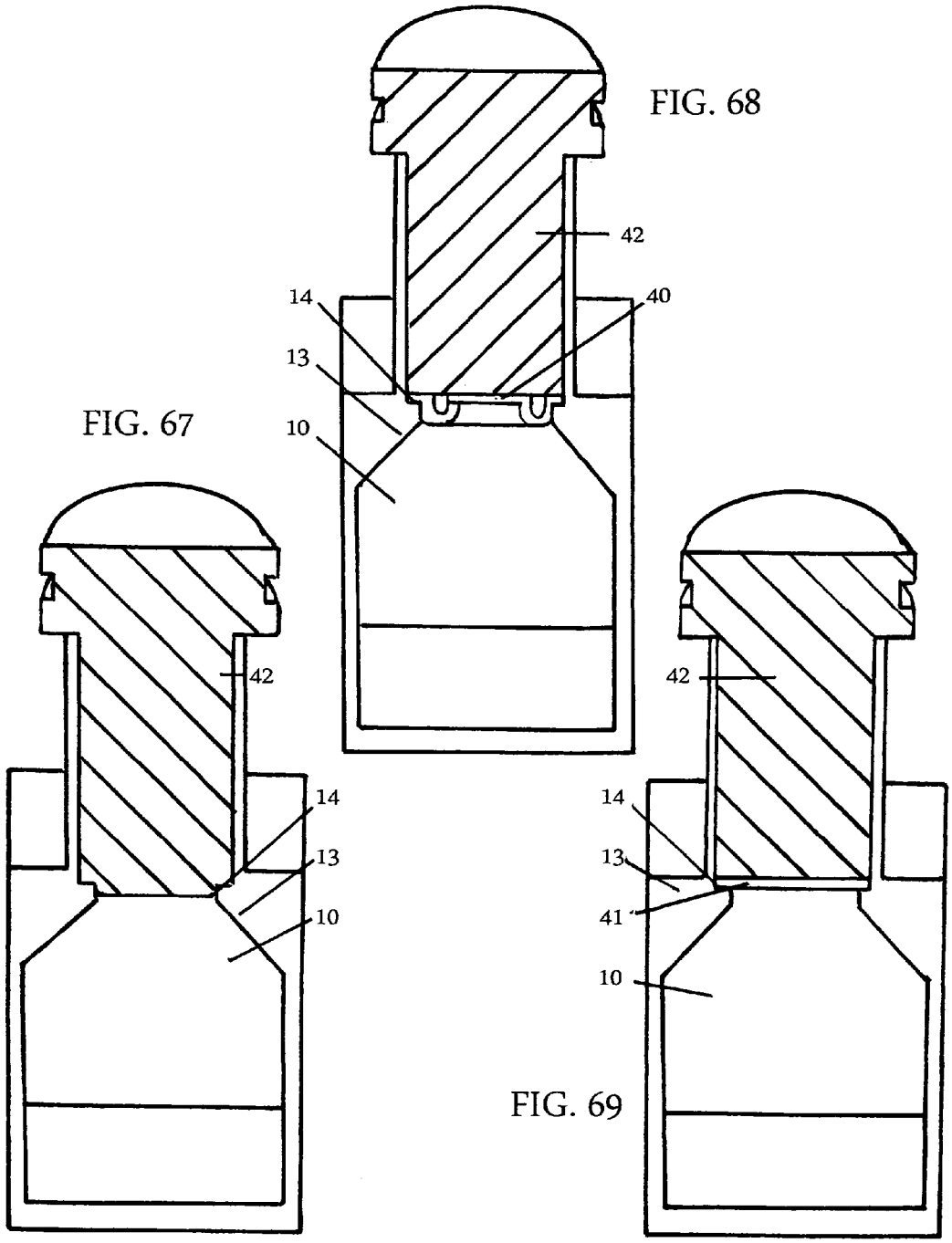

FIG. 67 is a square container half in perspective view with a plug half inserted.

FIG. 68 is a square container half in perspective view and a plug half with a plastic seal attached and inserted.

FIG. 69 is a square container half in perspective view and a plug half with a rubber seal attached and inserted.

Figure 70:
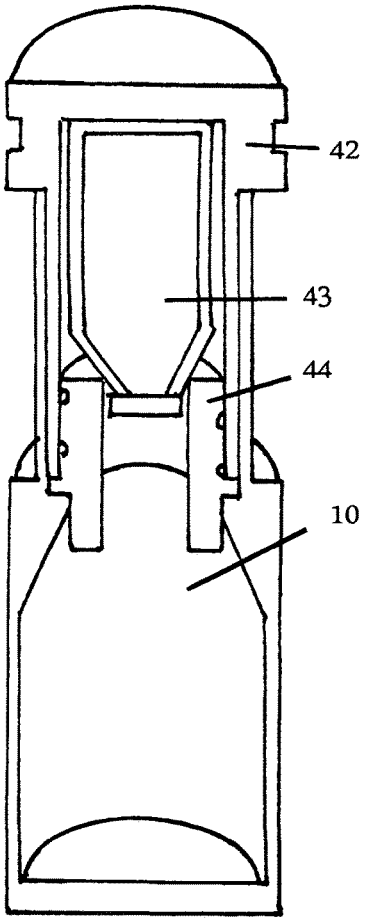

FIG. 70 is a round halved container in perspective view with a halved vial type plug inserted.

Figure 71:
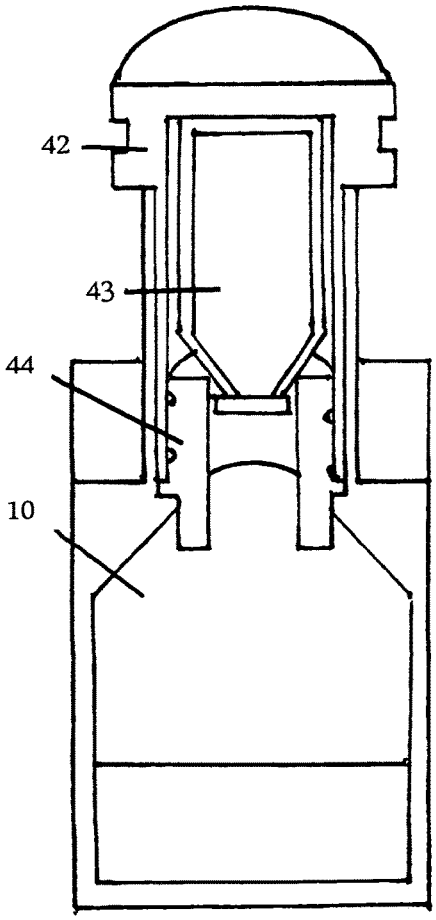

FIG. 71 is a square halved container in perspective view with a halved vial type plug inserted.

FIG. 72 in perspective view is a rubber cylinder.

FIG. 73 in perspective view is a plastic seal attachment.

FIG. 74 in perspective view is a bottom view of a plastic seal attachment.

FIG. 75 is a side view of a seal.

FIG. 76 is a threaded plug cap shown in a perspective view.

FIG. 77 is a snap on plug cap shown in perspective view.

FIG. 78 is a plug cap shown in perspective view.

FIG. 79 is a hollowed threaded vial securing device shown in perspective view.

FIG. 81 in perspective view is a five toothed hollowed plug.

FIG. 82 in perspective view is a five toothed hollowed plug with a snap on cap grove or bump.

FIG. 83 in perspective view is a five toothed hollowed plug with threads.

FIG. 84 in perspective view is a five toothed vial container plug.

FIG. 86 in perspective view is a four toothed hollowed plug.

FIG. 87 in perspective view is a four toothed hollowed plug with a snap on cap grove or bump.

FIG. 88 in perspective view is a four toothed hollowed plug with threads.

FIG. 89 in perspective view is a four toothed vial container plug.

FIG. 91 in perspective view is a ten toothed hollowed plug.

FIG. 92 in perspective view is a ten toothed hollowed plug with a snap on cap grove or bump.

FIG. 93 in perspective view is a ten toothed hollowed plug with threads.

FIG. 94 in perspective view is a ten toothed vial container plug.

FIG. 96 in perspective view is an eight toothed hollowed plug.

FIG. 97 in perspective view is an eight toothed hollowed plug with a snap on cap grove or bump.

FIG. 98 in perspective view is an eight toothed hollowed plug with threads.

FIG. 99 in perspective view is an eight toothed vial container plug.

FIG. 101 in perspective view is a five toothed hollowed plug with a rubber seal.

FIG. 102 in perspective view is a five toothed hollowed plug with a cap grove or bump and a rubber seal.

FIG. 103 in perspective view is a five toothed hollowed plug with a rubber seal and threads.

FIG. 105 in perspective view is a hollowed four toothed plug with a rubber seal.

FIG. 106 in perspective view is a hollowed four toothed plug with a snap on cap grove or bump and a rubber seal.

FIG. 107 in perspective view is a hollowed four toothed plug with threads and a rubber seal.

FIG. 109 in perspective view is a ten toothed cupped plug with a rubber seal.

FIG. 110 in perspective view is a ten toothed cupped plug with a cap grove or bump and a rubber seal.

FIG. 111 in perspective view is a ten toothed cupped plug with threads and a rubber seal.

FIG. 113 in perspective view is an eight toothed cupped plug with a rubber seal.

FIG. 114 in perspective view is an eight toothed cupped plug with a cap grove or bump and a rubber seal.

FIG. 115 in perspective view is an eight toothed cupped plug with threads and a rubber seal.

FIG. 117 in perspective view is a five toothed cupped plug with a plastic seal.

FIG. 118 in perspective view is a five toothed cupped plug with a cap grove or bump and a plastic seal.

FIG. 119 in perspective view is a five toothed cupped plug with threads and a plastic seal.

FIG. 121 in perspective view is a four toothed hollowed plug with a plastic seal.

FIG. 122 in perspective view is a four toothed hollowed plug with a plastic snap on cap grove or bump and a plastic seal.

FIG. 123 in perspective view is a four toothed hollowed plug with threads and a plastic seal.

FIG. 125 in perspective view is a ten toothed hollowed plug with a plastic seal.

FIG. 126 in perspective view is a ten toothed hollowed plug with a cap grove or bump and a plastic seal.

FIG. 127 in perspective view is a ten toothed hollowed plug with threads and a plastic seal.

FIG. 129 in perspective view is an eight toothed hollowed plug with a plastic seal.

FIG. 130 in perspective view is an eight toothed hollowed plug with a cap grove or bump and a plastic seal.

FIG. 131 in perspective view is an eight toothed hollowed plug with threads and a plastic seal.

FIG. 132 is a four tumbler, plug container type unit in perspective view.

FIG. 133 is a three tumbler, plug container type unit in perspective view.

FIG. 134 is a four tumbler, double slot, plug container type unit in perspective view.

FIG. 135 is a four tumbler, stator and tumbler cylinder half in perspective view.

FIG. 136 is a three tumbler, stator and tumbler cylinder half in perspective view.

FIG. 137 is a four tumbler, double slot, stator and tumbler cylinder half in perspective view.

FIG. 138 is a four tumbler, stator and tumbler cylinder half in perspective view.

FIG. 139 is a three tumbler, locking apparatus cylinder in perspective view.

FIG. 140 is a four tumbler double slot stator and tumbler cylinder in perspective view.

FIG. 141 in perspective view is an inverted five toothed hollowed plug.

FIG. 142 in perspective vie is an inverted four toothed hollowed plug.

FIG. 143 in perspective view is an inverted ten toothed hollowed plug.

FIG. 144 is a plastic seal insert shown in perspective view.

FIG. 145 is a rubber seal insert shown in perspective view.

REFERENCE NUMERALS

#10 a holding compartment
#11 stator insertion hole
#12 plug teeth alignment slot
#13 angled pill removal aid
#14 seal notch
#15 plug tooth
#16 tumbler concealment tooth
#18 top of plug
#19 stator protrusion
#20 stator slot
#21 stator
#22 tumbler slot
#23 stator alignment mark
#24 tumbler
#25 plug alignment mark
#26 indicia
#27 void
#28 ring
#29 groove
#30 cap
#31 threads
#32 threaded cap
#33 turning means
#35 turning means with spacing
#36 angled stator protrusion
#37 glue
#38 perforations
#39 half of plug tooth alignment slot
#40 plastic seal
#41 rubber seal
#42 halved plug
#43 halved vial
#44 halved securing device with hollow
#45 cylinder for four tumbler unit
#46 cylinder for three tumbler unit
#47 cylinder for four tumbler double slot unit
#48 paper

DESCRIPTION

First Embodiment

Figure 1:
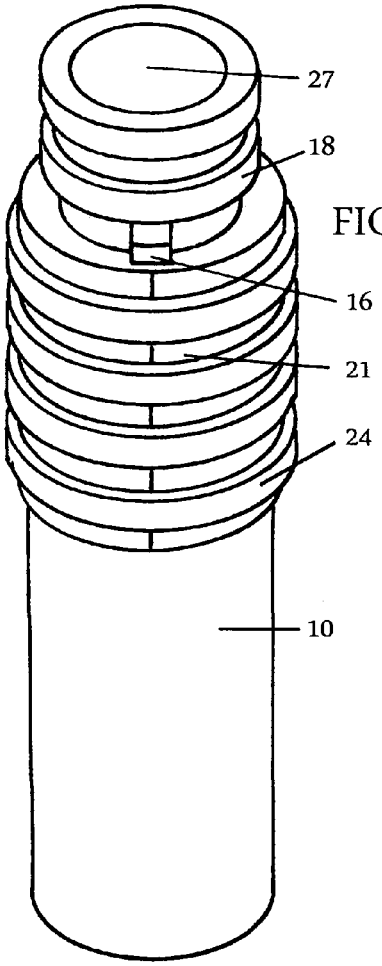
FIG. 1 is a round four tumbler unit in perspective view with four protrusion stators and a cup type plug.
Figure 18:
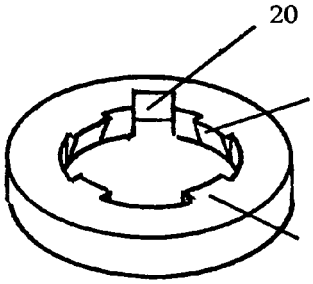
FIG. 18 is a single slot, four angled protrusion stator in perspective view.
Figure 22:
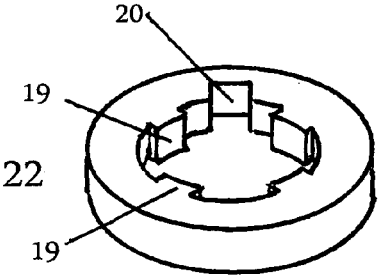
FIG. 22 is a single slot, four protrusion stator in perspective view.
Figure 25:
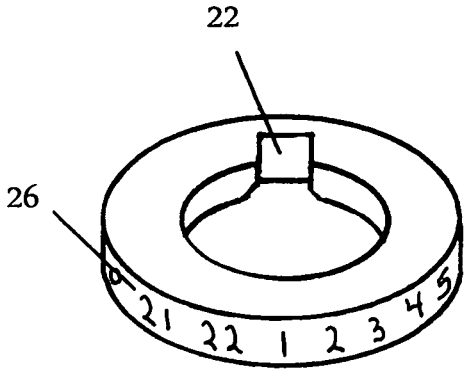
FIG. 25 is a single slot tumbler in perspective view.
Figure 26:
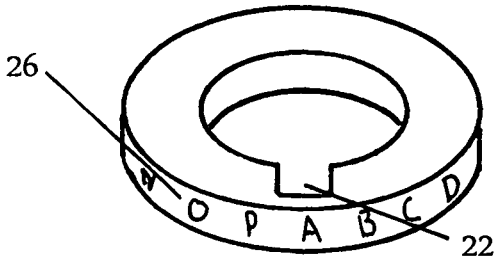
FIG. 26 is a single slot tumbler with varying indicia in perspective view.

FIG. 1 is a round four tumbler unit with four protrusion stators and a cup type plug. FIG. 1 may be made using five stators FIG. 22 or angled protrusion stators FIG. 18 and four tumblers FIG. 25 or varying indicia tumblers FIG. 26. FIG. 32 a container half may be joined to FIG. 33 the other container half to form FIG. 49 a round container 10 with a top cylinder with stator insertion holes 11, a slot 12, and a lip 14. A cup type plug FIG. 81 having a void 27, an alignment mark 25, a tumbler concealment tooth 16 and locking protrusions 15 may be replaced with other plugs FIG. 82, 83 or 84. The void 27 on FIG. 81 may be filled for medical purposes and sealed with another plug FIG. 78.

Figure 3:
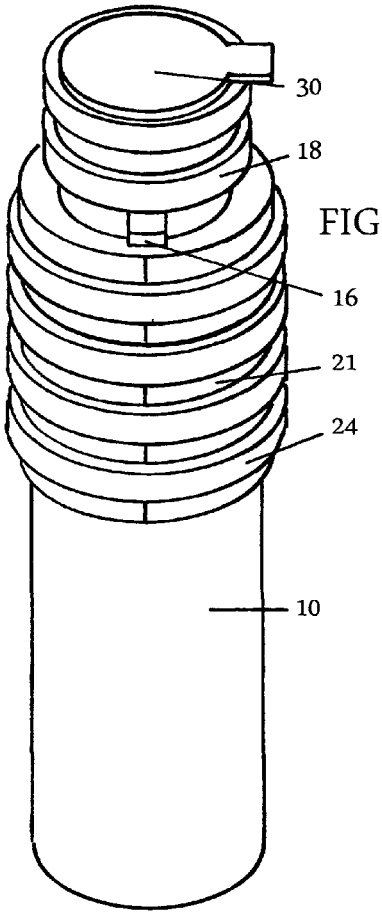
FIG. 3 is a round four tumbler unit in perspective view with three protrusion stators and snap cap type plug.
Figure 17:
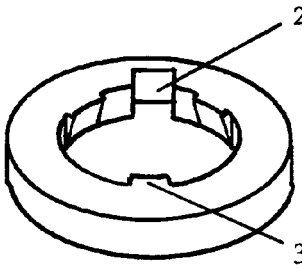
FIG. 17 is a single slot, three angled protrusion stator in perspective view.
Figure 21:
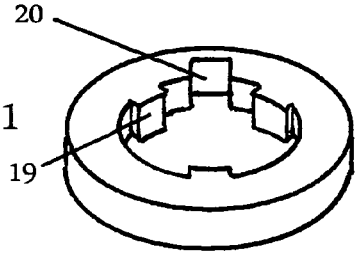
FIG. 21 is a single slot, three protrusion stator in perspective view.

FIG. 3 is a round four tumbler unit with three protrusion stators and a snap on cap type plug. FIG. 3 is made with five stators FIG. 21 or angled protrusion stators FIG. 17 and four tumblers FIG. 25 or varying indicia tumblers FIG. 26. FIG.

33 a container half may be joined to FIG. 34 the other container half to form FIG. 50 a container 10 with a top cylinder with stator insertion holes 11 a slot 12 and a lip 14. A snap on cap type plug FIG. 102 with a void 27, a groove 29, a concealment tooth 16, plug teeth 15 and a rubber gasket 41 may be replace with FIGS. 101 and 103. FIG. 72 is a rubber gasket glued to the base of the plug to seal the container 10. The cap FIG. 77 has a ring 28 and is referenced as number 30. Inserted into a groove 29 on the plug FIG. 102 the cap 30 seals the void to hold in any contents within the void 27.

Figure 5:
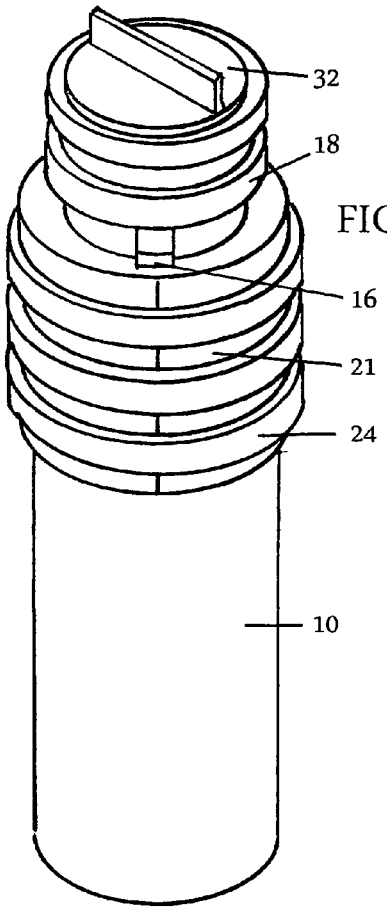
FIG. 5 is a round three tumbler unit in perspective view with four protrusion stators and threaded cap type plug.

FIG. 5 is a round three tumbler unit with four protrusion stators and a threaded cap type plug. FIG. 5 may be made with four stators FIG. 22 or angled protrusion stators FIG. 18 and three tumblers FIG. 25 or varying indicia tumblers FIG. 26. FIG. 35 a container half may be joined to FIG. 36 another container half to form FIG. 52 a container 10 with a top cylinder with stator insertion holes 11, a slot 12, and a lip 14. A plug FIG. 88 with a void, threads 31, a concealment tooth 16 and plug teeth 15 may be exchanged with plugs FIGS. 86, 87 and 89. The void 27 may be filled and secured with a threaded cap FIG. 76 by turning part 33 and interlacing the threads 31. Plug FIG. 89 may be used as a second locked container when a plug FIG. 76 is used.

Figure 11:
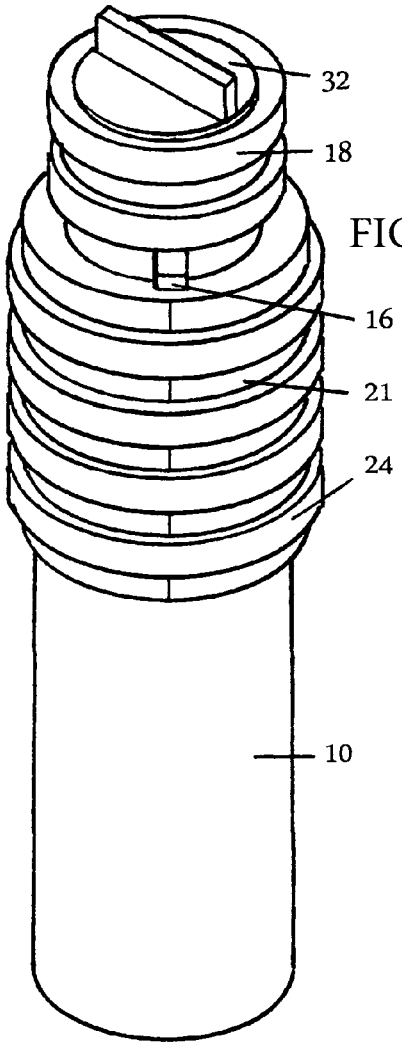
FIG. 11 is a four tumbler, double slotted, round unit in perspective view with two protrusion stators and threaded cap type plug.
Figure 20:
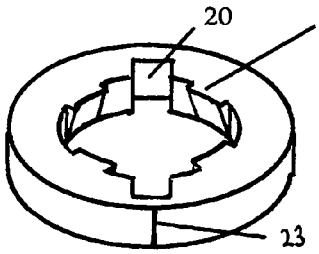
FIG. 20 is a double slotted, four angled protrusion stator in perspective view.
Figure 24:
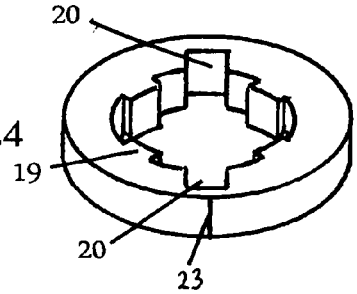
FIG. 24 is a double slot, four protrusion stator in perspective view.
Figure 27:
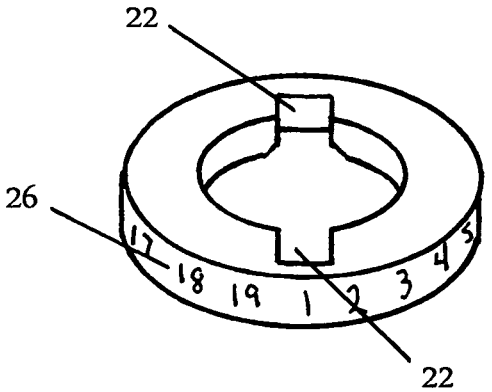
FIG. 27 is a double slot tumbler in perspective view.
Figure 28:
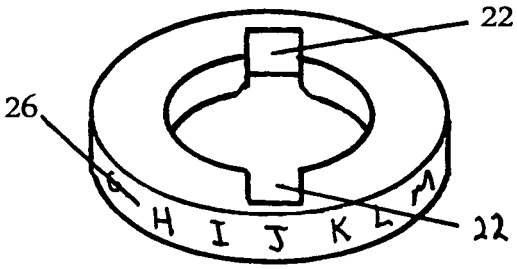
FIG. 28 is a double slot tumbler with varying indicia in perspective view.

FIG. 11 is a round four tumbler, double slotted unit with two protrusion stators and a threaded cap type plug. FIG. 11 may be made using five stators FIG. 24 or angled protrusion stators FIG. 20 and four tumblers FIG. 27 or varying indicia tumblers FIG. 28. FIG. 44 a container half may be joined to another container half FIG. 44 to form FIG. 54 a container 10 with a top cylinder with stator insertion holes 11, two plug alignment slots 12 and a lip 14. The plug FIG. 93 has threads 31, a void 27, concealing teeth 16, locking teeth 15 and a threaded cap 32. This plug may be exchanged with plugs FIGS. 91, 92 and 94 and capped with a threaded cap FIG. 76.

Figure 13:
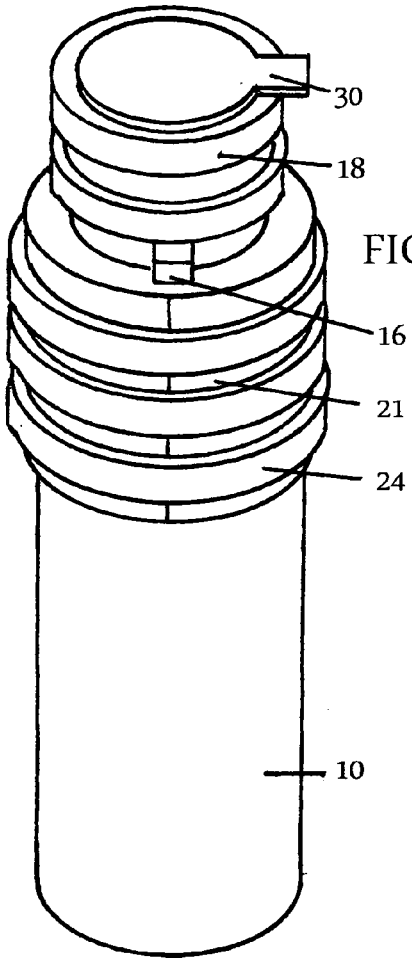
FIG. 13 is a three tumbler, double slotted, round unit in perspective view with four protrusion stators and cap type plug.

FIG. 13 is a round three tumbler, double slotted unit with four protrusion stators 21 and a snap on cap type plug. FIG. 13 may be made with four stators FIG. 24 or angled protrusion stators FIG. 20 and three tumblers FIG. 27 or varying indicia tumblers FIG. 28. FIG. 36 a container half may be joined to another half FIG. 36 to form FIG. 51 a container 10 with a top cylinder containing stator insertion holes 11, two slots 12 and a lip 14. The plug FIG. 130 has a groove 29, a void 27, concealment teeth 16, locking teeth 15 and a plastic seal 40. The plastic seal FIG. 73 may be glued to the base of the plug and seal the container lip 14 when inserted. This plug may be sealed with a cap 30 and variable plugs such as FIGS. 129 and 131 may be used.

Figure 15:
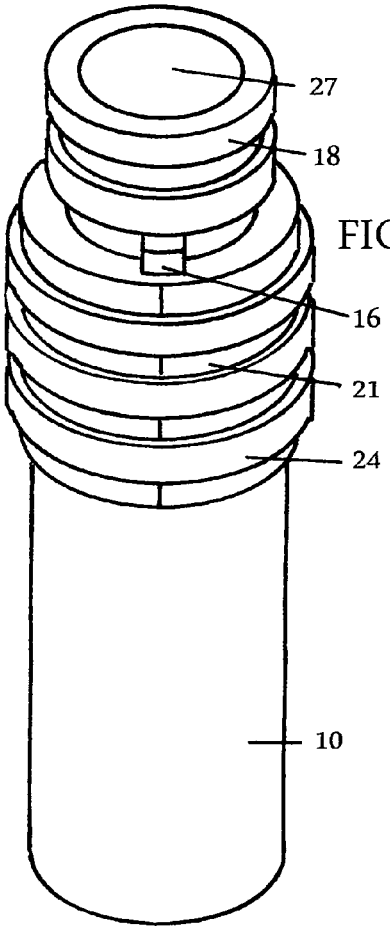
FIG. 15 is a three tumbler, double slotted, round unit in perspective view with two protrusion stators and cup type plug.
Figure 19:
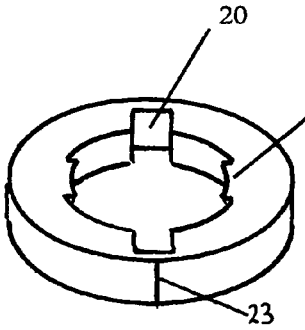
FIG. 19 is a double slot, two angled protrusion stator in perspective view.
Figure 23:
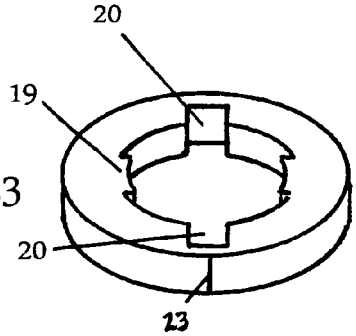
FIG. 23 is a double slot, two protrusion stator in perspective view.

FIG. 15 is a round three tumbler, double slotted unit with two protrusion stators and a cup type plug. FIG. 15 may be made with four stators FIG. 23 or angled protrusion stators FIG. 19 and three tumblers FIG. 27 or varying indicia tumblers FIG. 28. FIG. 45 a container half with two halved plug tooth alignment slots 39 may be joined to another container half FIG. 45 to form FIG. 55 a container 10 with a top cylinder containing stator insertion holes 11, two slots 12 and a lip 14. The plug FIG. 96 has a hollow 27, alignment marks 25, concealment teeth 16, locking teeth 15 and a rubber gasket 41. Plugs shown as FIGS. 114 and 115 may also be used.

All units FIGS. 1, 3, 5, 11, 13 and 15 may be labeled with a label FIG. 29 made of paper 48 and glue 37 or FIG. 30 a paper and glue label with tear away perforations 38. FIG. 31 shows the folding of a perforated label used for multiple labeling.

The stators and plugs may vary as well as the number of tumblers. These units provide several variations of the first embodiment and should not be construed as to limit this embodiment. They all may be made of plastic by an injection molding machine. The joined parts may be produced by thermal joining, vibrational welding or other joining techniques. The base of the container may be thickened to strengthen the containers. Thermal reduction or other means may produce the indentations on parts and they may just be painted on.

The hand grip on the plugs and the indent on the indicia make handling easy. Assembling the unit with the snap in capability of the stators is simple and quick. And the bottom stator may be made on the container. Other advantages such as the sterility of the units, with the use of polypropylene, may become apparent as the familiarity of the units increase.

Operation

First Embodiment

The stator is applied to the unit around the top cylinder and moved into place. The stator protrusions 19 or the angled stator protrusion 36 hold the stator in place. The tumbler 24 is added around the cylinder and another stator placed above it. This holds the tumbler in place vertically and the cylinder holds it horizontally. This process is repeated until the tumblers are secure.

The plug is inserted into the top cylinder by aligning the alignment mark 25 to the stator alignment mark 23 and inserting it through the stator slots 20 into the top cylinder. The container is locked and sealed by turning the tumblers. The sealing is shown in FIGS. 64, 65 and 66 and created by the plug seals being against the lip. The concealment tooth 16 covers the top tumbler notch location. The plug is then fitted with the appropriate cap.

Unlocking is simply done by aligning the indicia 26 of all tumblers, with corresponding notch locations, to the alignment marks. Removing the plug creates a cavity for pill insertion or removal and the angled container aid 13 produces an easy flow when dispensing.

DESCRIPTION

Second Embodiment

Figure 2:
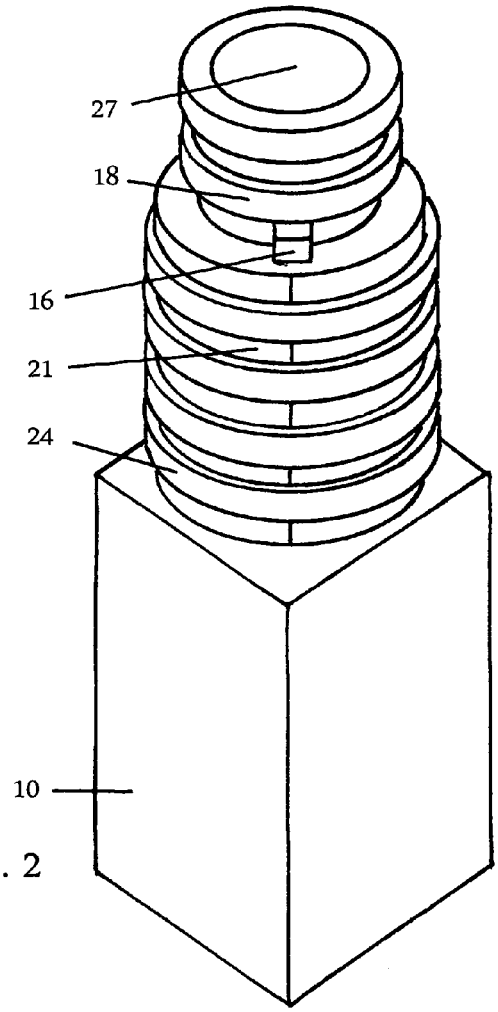
FIG. 2 is a square four tumbler unit in perspective view with three protrusion stators and a cup type plug.

FIG. 2 is a square four tumbler unit with three protrusion stators and a cup type plug. FIG. 2 is made with five stators FIG. 21 or five angled protrusion stators FIG. 17 and four tumblers FIG. 25 or varying indicia tumblers FIG. 26. FIG. 39 a container half, may be joined to another container half FIG. 40 to form FIG. 57 a container 10 with a top cylinder with stator insertion holes 11, a slot 12 and a lip 14. The cup type plug FIG. 117 with a void 27, an alignment mark 25, a concealing tooth 16, teeth 15 and a plastic grommet 40 may be replaced with FIG. 118 or 119. The plastic grommet FIG. 73 may be attached to seal the contents of the container 10. FIG. 74 and FIG. 75 show varying images of the plastic seal 40.

Figure 4:
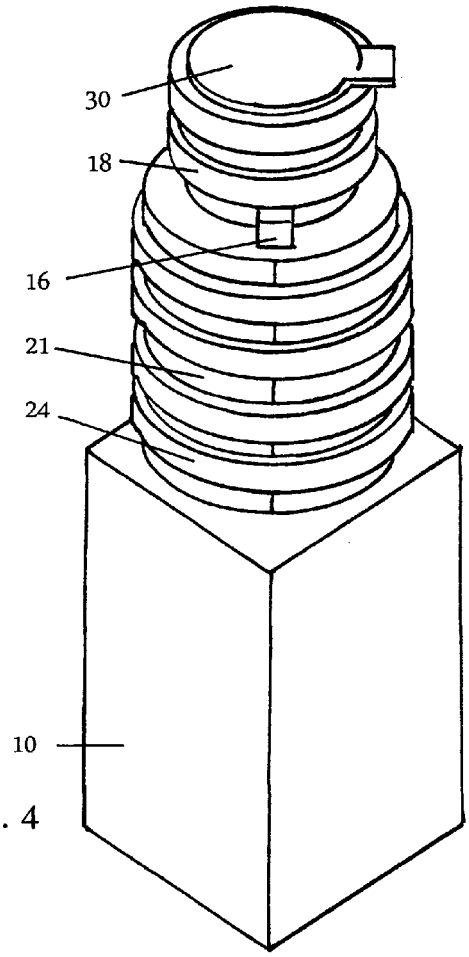
FIG. 4 is a square four tumbler unit in perspective view with four protrusion stators and snap on cap type plug.

FIG. 4 is a square four tumbler unit with four protrusion stators and a cap type plug. FIG. 4 may be made with five stators FIG. 22 or angled protrusion stators FIG. 18 and four tumblers FIG. 25 or varying indicia tumblers FIG. 26. FIG. 38 a container half may be joined to FIG. 39 another container half to form FIG. 56 a container 10 with a top cylinder having stator insertion holes 11, a slot 12 and a lip 14. The plug FIG. 102 has a void 27, a groove 29, a concealment tooth 16, locking teeth 15 and a plastic seal 41. The plastic seal FIG. 72 may be glued on the base of the plug to protect the contents in the container 10 when pressed onto the lip 14. The teeth 15 of the plug may be angled to force the plug tightly into place when the tumblers are moved. The tumblers may also be angled at the teeth notch 22 to produce the same effect.

Figure 6:
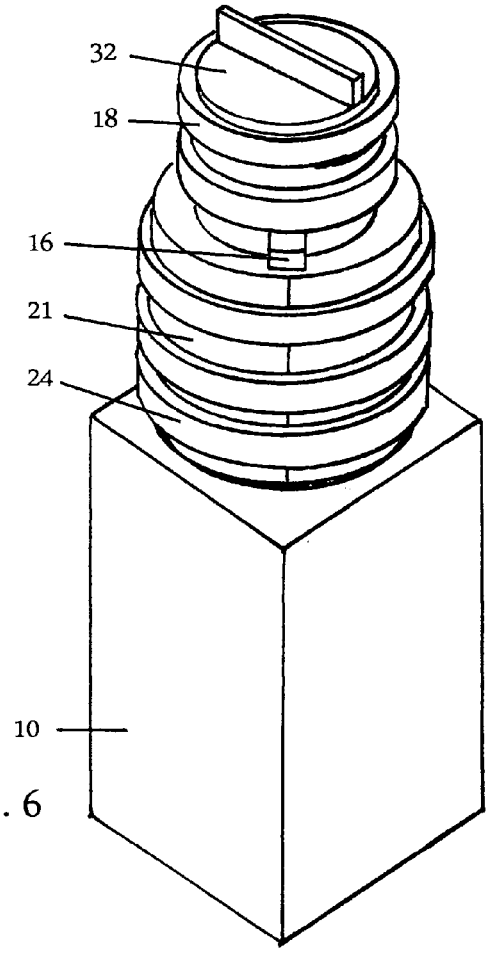
FIG. 6 is a square three tumbler unit in perspective view with three protrusion stators and threaded cap type plug.

FIG. 6 is a square three tumbler unit with three protrusion stators and a threaded cap type plug. FIG. 6 may be made with four stators FIG. 21 or angled protrusion stators FIG. 17 and three tumblers FIG. 25 or varying indicia tumblers FIG. 26. FIG. 42 a container half may be joined to FIG. 43 another container half to form FIG. 59 a container 10 with stator insertion holes 11, a slot 12 and a lip 14. A threaded plug FIG. 107 with a void 27, threads 31, a concealment tooth 16, locking teeth 15 and a rubber gasket 41 may be replaced with plugs FIG. 104, 105, 106 and variable seal plugs shown in FIGS. 121, 122 and 123 and sealed with a threaded cap FIG. 76.

Figure 12:
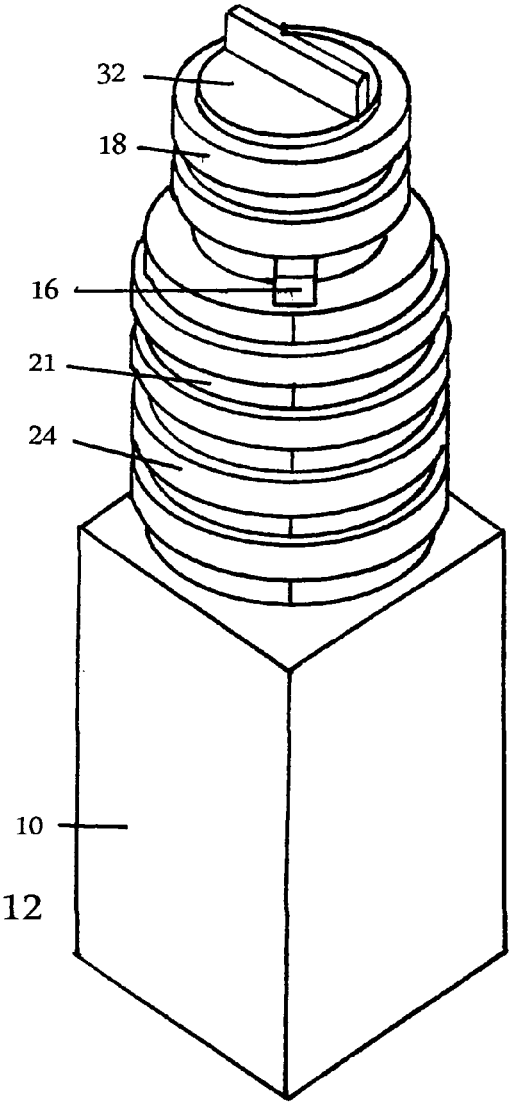
FIG. 12 is a four tumbler, double slotted, square unit in perspective view with four protrusion stators and threaded cap type plug.

FIG. 12 is a square four tumbler, double slotted unit with four protrusion stators and a threaded cap type plug. FIG. 12 may be made with five stators FIG. 24 or angled protrusion stators FIG. 20 and four tumblers FIG. 27 or varying indicia tumblers FIG. 28. FIG. 39 a container half may be joined with FIG. 39 a container half to form FIG. 60 a container 10 with a cylinder having stator insertion holes 11, two slots and a lip 14. The plug 18 shown as FIG. 111 has a void 27, threads 31, concealment teeth 16, locking teeth 15 and a rubber gasket 41 to seal the container 10. The plug is capped with a threaded cap FIG. 76. Other plugs FIGS. 109 and 110 may also be used. The entire unit may become a double container with the use of a plug FIG. 94 and a seal FIG. 76. When used like this both the plug void 27 and the container 10 may be separated and locked.

Figure 14:
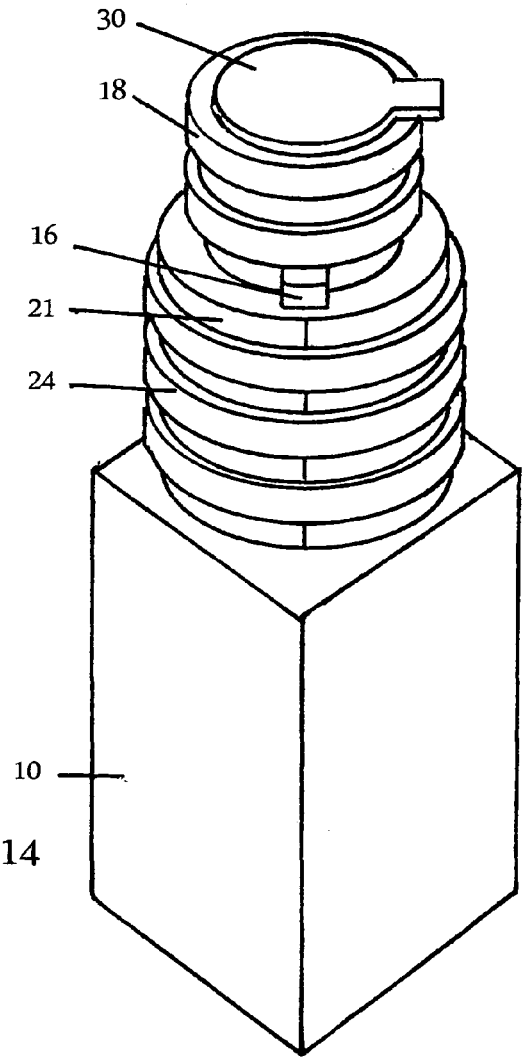
FIG. 14 is a three tumbler, double slotted, square unit in perspective view with two protrusion stators and cap type plug.

FIG. 14 is a square, three tumbler, double slotted unit with two protrusion stators and a snap on cap type plug. FIG. 14 may be made with four stators FIG. 23 or angled protrusion stators FIG. 19 and three tumblers FIG. 27 or varying indicia tumblers FIG. 28. FIG. 47 a container half may be joined with another half FIG. 47 to form FIG. 63 a container 10 with a cylinder having stator insertion holes 11, two slots 12 and a lip 14. The plug FIG. 97 may be filled and sealed with a cap FIG. 77. Variable plugs include FIGS. 96, 98 and 99.

Figure 16:
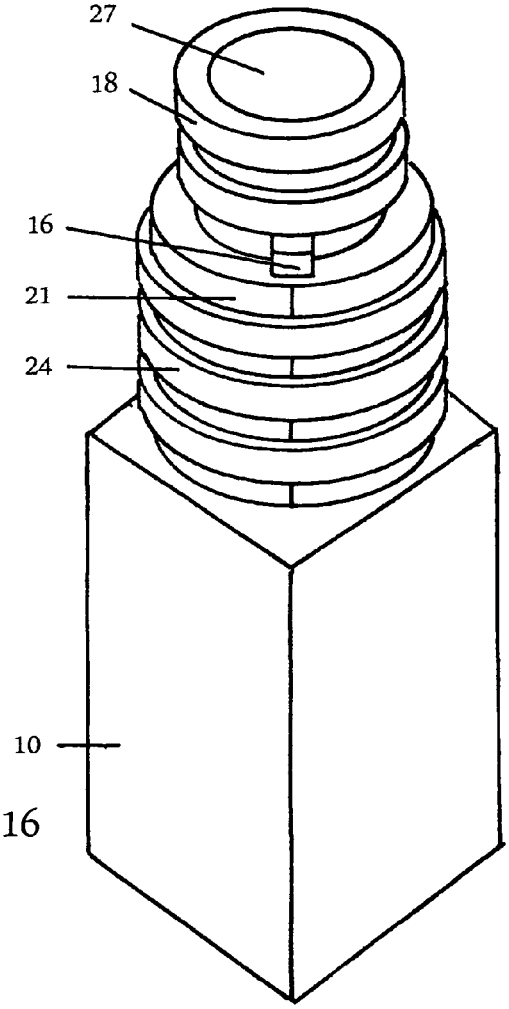
FIG. 16 is a three tumbler, double slotted, square unit in perspective view with four protrusion stators and cup type plug.

FIG. 16 is a square three tumbler, double slotted unit with four protrusion stators and a cup type plug. FIG. 16 may be made with four stators FIG. 24 or angled protrusion stators FIG. 20 and three tumblers FIG. 27 or varying indicia tumblers FIG. 28. FIG. 42 a container half may be joined with another half FIG. 42 to make FIG. 61 a container 10 with a cylinder having stator insertion holes 11, two slots 12 and a lip 14. FIG. 96 a snap on cap type plug may be used to secure the contents of the container 10 and a variety of other plugs may be used.

All units FIGS. 2, 4, 6, 12, 14 and 16 may be labeled with FIG. 29, FIG. 30 or other informative print may be added. The flat surface may provide easier hand writing on the labels, the shipping cost may be lower and saving store shelf space are advantages of this embodiment. The container volume may be another advantage of this embodiment.

These units provide several variations of the second embodiment and should not limit the scope of this invention. The parts may be made of plastic by an injection molding machine. The joined parts may be produced with thermal joining, chemical bonding or other techniques. The parts may be painted and colors and translucency may be changed.

Larger top cylinders and the incorporation of the bottom stator to the container for manufacture abilities may be incorporated with this as well as the first and third embodiments. The unique plastic lock with a transparent container and solid colored tumblers and stators make this an inexpensive quality product. Measurements for the liquids may be added to the plugs and the inner sides of the top cylinder may be sealed for liquid medications.

Operation

Second Embodiment

Operation of this embodiment is the same as the first embodiment with the exception of the seal references. Seals referenced in this embodiment are shown as FIGS. 67, 68 and 69.

DESCRIPTION

Third Embodiment

Figure 7:
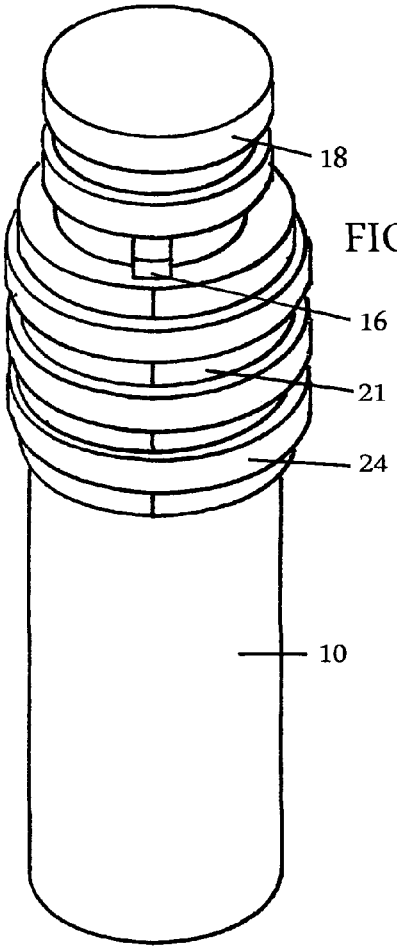
FIG. 7 is a round three tumbler unit in perspective view with four protrusion stators and vial type plug.

FIG. 7 is a round three tumbler unit with three protrusion stators and a vial type container. FIG. 7 may be made with four stators FIG. 21 or angled protrusion stators FIG. 17 and three tumblers FIG. 25 or varying indicia tumblers FIG. 26. FIG. 36 a container half may be joined to FIG. 37 another container half to form FIG. 53 a container 10 with a cylinder having stator insertion holes 11, a slot 12 and a lip 14. The plug FIG. 89 has an alignment mark 25, a concealment tooth 16, locking teeth 15 and threads 31 within a void 27 for a threaded vial securing device FIG. 79. FIG. 79 has a void 27 for needle insertion, a turning means 35 and threads 31. The lengths and widths of FIG. 79 may vary to accommodate different vial sizes and provides a secured vial when pressed within the void 27. This unit may be converted to a non-vial unit by changing the plug with FIGS. 86, 87 and 88.

Figure 8:
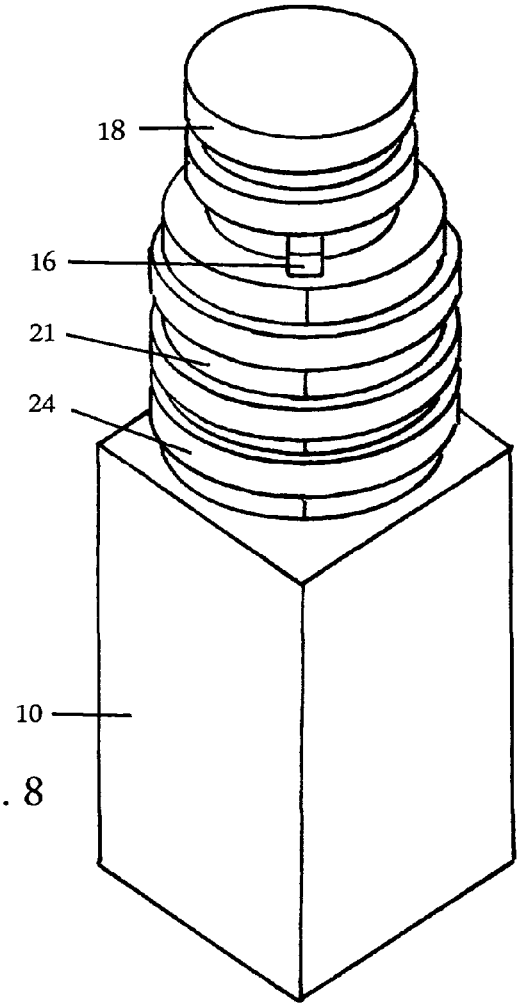
FIG. 8 is a square three tumbler unit in perspective view with four protrusion stators and vial type plug.

FIG. 8 is a square three tumbler unit with four protrusion stators and a vial type container. FIG. 8 may be made with four stators FIG. 22 or angled protrusion stators FIG. 18 and three tumblers FIG. 25 or varying indicia tumblers FIG. 26. FIG. 42 a container half may be joined with another container half FIG. 41 to form FIG. 58 a container 10 with a cylinder having stator insertion holes 11, a slot 12 and a lip 14. The plug FIG. 89 when complete with a vial securing part FIG. 79 may press a vial tightly within the container while allowing access to the contents through a void 27. This unit may be used with plugs FIGS. 105, 106 and 107 and FIGS. 121, 122 and 123.

Figure 9:
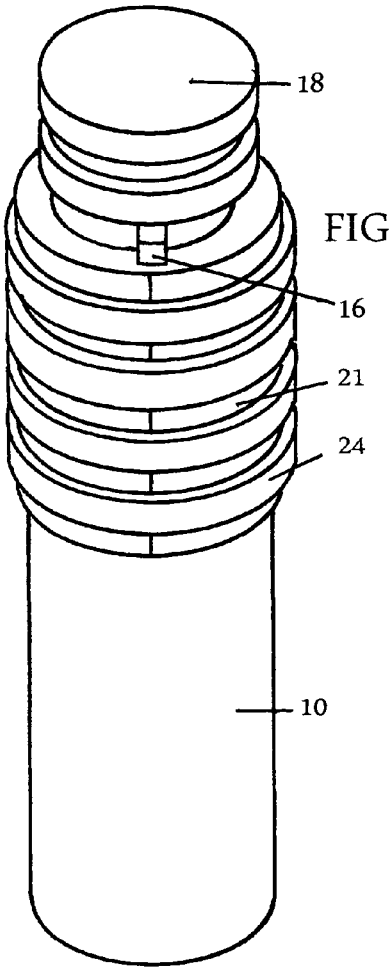
FIG. 9 is a four tumbler, double slotted, round unit in perspective view with four protrusion stators and vial type plug.

FIG. 9 is a four tumbler, double slotted, round unit with four protrusion stators and a vial type container. FIG. 9 may be made with five stators FIG. 24 or angled protrusion stators FIG. 20 and four tumblers FIG. 27 or with varying indicia tumblers FIG. 28. FIG. 33 a container half may be joined with another half FIG. 33 to form FIG. 48 a container 10 with a cylinder having stator insertion holes 11, two slots 12 and a lip 14. The plug FIG. 94 has an alignment mark 25, concealment teeth 16, locking teeth 15 and threads 31. Other plugs may be used to form a seal at the base of the plug such as FIGS. 91, 92 and 93.

Figure 10:
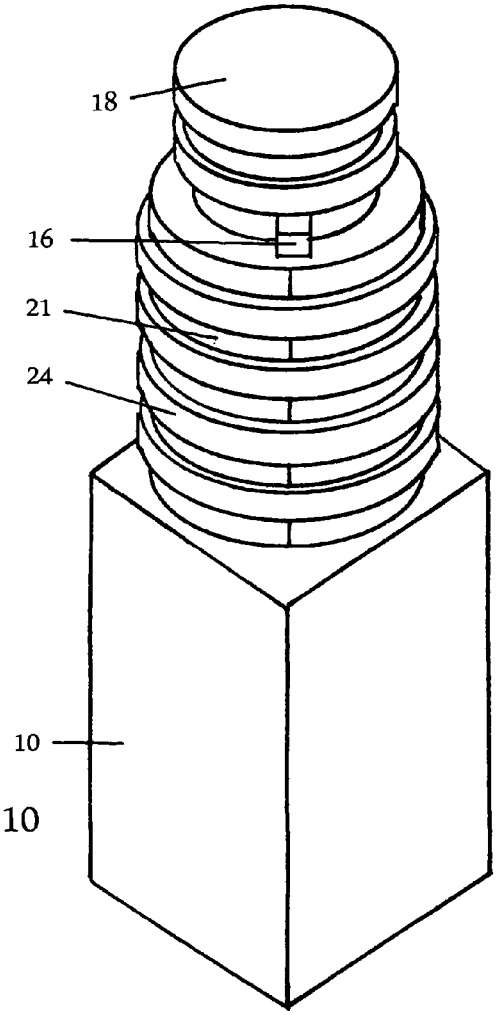
FIG. 10 is a four tumbler, double slotted, square unit in perspective view with two protrusion stators and vial type plug.

FIG. 10 is a square four tumbler, double slotted unit with two protrusion stators and a vial type plug. FIG. 10 may be made with five stators FIG. 23 or angled protrusion stators FIG. 19 and four tumblers FIG. 27 or with varying indicia FIG. 28. A container half FIG. 46 may be joined with another container half FIG. 46 to form FIG. 62 a square container with a cylinder having stator insertion holes 11, two slots 12 and a lip 14. The plug FIG. 94 may be replaced with plugs FIGS. 124, 125, 126 and 127. The plug FIG. 94 with a void 27 may be used as a second locked container when a cap FIG. 76 is used. Other plugs FIGS. 109, 110 and 111 and FIGS. 125, 126 and 127 may be used.

All units FIGS. 7, 8, 9 and 10 may labeled with FIG. 29 and FIG. 30. The plugs may be used as a locked storage device with the use of a cap. The locked needle storage and locked vial as well as the dual locked containers define parts of this embodiment. These units show several variations of the third embodiment and are not intended to limit the scope of this invention.

The parts may be made of plastic by an injection molding machine, joined and painted. The vial screw size may change to accommodate different vial sizes. FIG. 70 and FIG. 71 show vials inserted and held in place by the halved securing device with a hollow 44. And the container may be extended for needle storage.

Operation

Third Embodiment

Many of the operations of this embodiment are the same as in the first embodiment. You may fill the container with needles instead of medication and place the vial in the base of the plug and secure it with the vial screw and insert it into the container to lock both the needles and vial.

Open the locked container to remove a needle and simply insert it into the vial through the securing device. The translucency of the plug may aid in viewing the needle to vial operation and the plug may have indicia for vial measurements. The plug is held as a vial would normally be and the needle inserted to draw medication. The vial securing references are shown as FIG. 70 a round container half and FIG. 71 a square container half. Both figures are shown with halved plugs 42, halved vials 43 and halved securing devices 44.

The plugs used in this embodiment allow a locked plug as well as the originally locked containers with the use of the cap FIG. 76. Unlock the container, remove the plug and unscrew the cap FIG. 76 to remove the contents.

DESCRIPTION

Fourth Embodiment

FIG. 132 is a four tumbler, plug container type unit. FIG. 132 may be made using four stators FIG. 22 or angled protrusion stators FIG. 18 and four tumblers FIG. 25 or varying tumblers FIG. 26. The cylinder 45 is formed by joining FIG. 135 a cylinder half with its mirrored image half and is shown as FIG. 138 a complete cylinder. It may be converted into a single mold cavity cylinder with an extended top portion having stator holes 11 and assembled with another stator. The cylinder contains stator insertion holes 11 and a slot 12 formed when joining the two halved slots 39 on the cylinder half. The plug FIG. 141 has a void 27, locking teeth 15, a concealment tooth 16 and a plug a grip 18.

FIG. 133 is a three tumbler, plug container type unit. FIG. 133 may be made using three stators FIG. 22 or angled protrusion stators FIG. 18 and three tumblers FIG. 25 or varying indicia tumblers FIG. 26. The cylinder 46 is formed by joining FIG. 136 a cylinder half with its mirrored image half and is shown as FIG. 139 a complete cylinder. The cylinder contains stator insertion holes 11 and a slot 12 formed when the two halves are joined. The cylinder may be made in a single cavity mold with an extended top part having stator holes 11 and another stator placed at the top. The plug FIG. 142 has a void 27, locking teeth 15, a concealment tooth 16 and a plug grip 18.

FIG. 134 is a four tumbler, double slot, plug container type unit. FIG. 134 may be made using four stators FIG. 24 or angled protrusion stators FIG. 20 and four tumblers FIG. 27 or varying indicia tumblers FIG. 28. The cylinder 47 is formed by joining FIG. 137 to its mirrored image half and is shown as FIG. 140 a complete cylinder. It may be made in a single cavity mold with an extended top portion and stator insertion holes. An additional stator placed above the top tumbler secures the tumbler. The cylinder contains stator insertion holes 11 and two slots when the two halves are joined. A plug FIG. 143 has a void 27, locking teeth 15 and a concealment tooth 16. The inside top of the cylinders 45, 46 and 47 may have a plastic seal FIG. 144 or rubber seal FIG. 145 attached or the plugs may be threaded and a cap applied. The number of stators and tumblers may vary as well as the number of stator protrusions. These units provide several variations of the fourth embodiment and should not be construed as to limit this embodiment. The parts may be made of plastic by an injection molding machine and joined. A label may be applied to the tumblers or the previously mentioned method may be used.

The size of these units and the manufacturer costs are distinctions of this embodiment. The inverted plug may have use in the other embodiments as well. For example a double container joined at the bases would produce a four chamber unit etc. . . . .

Operation

Fourth Embodiment

The operation of this embodiment is the same as in the first embodiment with the exception of the pill removal. The completed cylinder is lifted after unlocking and the plug is removed from the bottom. The plug and its' contents may be filled and reinserted into the bottom of the cylinder to be relocked.

CONCLUSION, RAMIFICATIONS AND SCOPE

While there have been many locking containers few have had any success worthy of mentioning. None have had any commercial success. This locking container and its alternative embodiments are clearly designed to fulfill the need for such a device. These units also give the means to reduce drug dependency, pharmaceutical overdoses and death. I am in the hopes it will become an option at your local pharmacy and you choose to protect others yourself.

The container and securing means as one piece aim to keep the price down. With the snap on parts assemblies easily completed. The plastics used fill the federal drug administration requirements and the seals put this in a class 1 FDA medical container.

Although the description above contains many variations, it should not be construed as limiting the scope of the embodiments but as merely providing illustrations of some of the presently preferred embodiments. Other advantages have been omitted for the clarity of this application such as, 1. Holding the unit is very comfortable and natural.
2. The cup within the container is convenient and when filled with water and capped very useful.

3. The needle storage and vial together eliminate locating commonly separated items.
4. the locked plug enables the owner to place separate medications into one locking container.
5. The room for your fingers produced by the stators to move the tumblers simplifies the use of the units significantly.

Thus the scope of the embodiments should be determined by the appending claims and their legal equivalents, rather than by the examples given.

I claim:

1. A locking plug container comprising:

a. a compartment;

b. a flexible locking segment with holes inset within, and defining a plug placement area;

c. one or more stators attached by protruding parts inserted into the holes in the flexible locking segment;

d. one or more tumblers with indicia secured on the flexible locking segment by at least one of said stators;

e. a plug with teeth and with an outwardly openable compartment therein;

f. wherein the one or more tumblers can be rotated around the flexible locking segment to interfere with the teeth on the plug and lock the plug onto the container in order to prevent unauthorized access to the compartment.

2. The locking container of claim 1, wherein the tumbler or tumblers are changeable when the plug is absent from the plug placement area.

* * * * *